US012781500B2

(12) United States Patent
Raschke et al.

(10) Patent No.: US 12,781,500 B2
(45) Date of Patent: Nov. 3, 2026

(54) EXTERIOR SEALING SYSTEM FOR CONSTRUCTION MODULES

(71) Applicant: Permasteelisa North America Corp., Mendota Heights, MN (US)

(72) Inventors: Ryan Raschke, Portland, OR (US); Alexander Wilson, Milwaukie, OR (US); Kirt Smith, Portland, OR (US); Jason Buchheit, New York, NY (US); Jared Adams, Mission Viejo, CA (US)

(73) Assignee: PERMASTEELISA NORTH AMERICA CORP., Mendota Heights, MN (US)

( * ) Notice: Subject to any disclaimer, the term of this patent is extended or adjusted under 35 U.S.C. 154(b) by 271 days.

(21) Appl. No.: 18/505,313

(22) Filed: Nov. 9, 2023

(65) Prior Publication Data

US 2024/0159050 A1 May 16, 2024

Related U.S. Application Data

(60) Provisional application No. 63/383,214, filed on Nov. 10, 2022.

(51) Int. Cl.
*E04B 2/90* (2006.01)

(52) U.S. Cl.
CPC ..... *E04B 2/90* (2013.01)

(58) Field of Classification Search
CPC ..... E04B 2/90
See application file for complete search history.

(56) References Cited

U.S. PATENT DOCUMENTS

| | | | | |
|---|---|---|---|---|
| 7,827,738 | B2 | 11/2010 | Abrams et al. | |
| 7,987,644 | B2 * | 8/2011 | Walker, III | E04B 2/90 52/656.5 |
| 8,413,403 | B2 * | 4/2013 | Walker, III | E04B 2/90 52/204.5 |
| 2011/0265404 | A1 | 11/2011 | Walker, III et al. | |
| 2024/0159050 | A1 * | 5/2024 | Raschke | E04B 2/96 |

FOREIGN PATENT DOCUMENTS

| | | | |
|---|---|---|---|
| GB | 2602746 | A | 7/2022 |
| WO | 2010124342 | A1 | 11/2010 |

OTHER PUBLICATIONS

European Patent Office, Extended European Search Report, European Application No. 23208904.5-1005, dated Mar. 11, 2024, 7 pages.

* cited by examiner

*Primary Examiner* — Andrew J Triggs
(74) *Attorney, Agent, or Firm* — DLA PIPER LLP US

(57) ABSTRACT

A modular building assembly of a building includes a modular building unit that forms a portion of the building. The modular building unit includes a structural frame having an exterior side arranged adjacent to an exterior of the building. A façade is mounted on the structural frame. A joining frame is mounted on the structural frame of the modular building unit independently of the façade. The joining frame includes a weather-proofing interface extending along an outer perimeter of the joining frame. The weather-proofing interface engages a joining frame of at least one other modular building assembly to form a seal with the at least one other modular building assembly when the modular building assembly and at least one other modular building assembly are arranged next to one another in the building.

10 Claims, 17 Drawing Sheets

EXTERIOR SEALING SYSTEM FOR CONSTRUCTION MODULES

CROSS-REFERENCE TO RELATED APPLICATION

This application claims priority to U.S. Provisional Application No. 63/383,214, filed Nov. 10, 2022, the entirety of which is hereby incorporated by reference.

FIELD

The present disclosure generally relates to modular construction and, more particularly, to an exterior sealing system for modular building units used in modular construction.

BACKGROUND

Construction modules or modular building units are used to construct a building by arranging (e.g., stacking, placing side-by-side, placing end-to-end, etc.) the modules relative to one another. Modular building units arranged together to form the building must be sealed to prevent water from getting into the building.

SUMMARY

In one aspect, an exterior joint system is disclosed for a modular building unit forming a portion of a building. The building has other modular building units. The exterior joint system comprises an elongate, upper frame member configured to be attached to an upper structural member of the modular building unit. The upper frame member includes a first weather-proofing interface configured to engage a first exterior joint system of a first other modular building unit to form a seal with said first exterior joint system when the upper frame member is attached to the modular building unit and the modular building unit is positioned adjacent said first other modular building unit. An elongate, lower frame member is configured to be attached to a lower structural member of the modular building unit. The lower frame member includes a second weather-proofing interface configured to engage a second exterior joint system of a second other modular building unit to form a seal with said second exterior joint system when the lower frame member is attached to the modular building unit and the modular building unit is positioned adjacent said second other modular building unit. An elongate, first side frame member is configured to be attached to a first side structural member of the modular building unit. The first side frame member includes a third weather-proofing interface configured to engage a third exterior joint system of a third other modular building unit to form a seal with said third exterior joint system when the first side frame member is attached to the modular building unit and the modular building unit is positioned adjacent said third other modular building unit. An elongate, second side frame member is configured to be attached to a second side structural member of the modular building unit. The second side frame member includes a fourth weather-proofing interface configured to engage a fourth exterior joint system of a fourth other modular building unit to form a seal with said fourth exterior joint system when the second side frame member is attached to the modular building unit and the modular building unit is positioned adjacent said fourth other modular building unit. The upper and lower frame members are configured to connect to and extend between the respective first and second side frame members such that the upper, lower, first side and second side frame members define a facade opening sized and shaped to receive a portion of a facade of the building.

In another aspect, a modular building assembly for a building comprises a modular building unit configured to form a portion of the building. The modular building unit includes a structural frame having an exterior side configured to be arranged adjacent to an exterior of the building. An exterior joint system is mounted to the exterior side of the structural frame. The exterior joint system defines a facade opening sized and shaped to receive a portion of a facade of the building. The exterior joint system includes a weather-proofing interface extending along an outer perimeter of the exterior joint system. The weather-proofing interface is configured to engage an exterior joint system of at least one other modular building assembly to form a seal with said at least one other modular building assembly when the modular building assembly and at least one other modular building assembly are arranged next to one another in the building.

In another aspect, a method of constructing a building comprises attaching an exterior joint system to an exterior side of a structural frame of a modular building unit. The exterior joint system has a weather-proofing interface extending along an outer perimeter of the exterior side of the modular building unit when the exterior joint system is attached to the exterior side of the modular building unit. The exterior joint system defines a facade opening sized and shaped to receive a portion of a facade of the building. Said attaching includes aligning the facade opening with an exterior opening defined by the exterior side of the structural frame of the modular building unit. The method may also include positioning the modular building unit next to another modular building unit such that the weather-proofing interface of the exterior joint system engages a weather-proofing interface of an exterior joint system attached to the other modular building unit to form a seal between the exterior joint systems.

In another aspect, a modular building assembly for a building comprises a modular building unit configured to form a portion of the building. The modular building unit includes a structural frame having an exterior side configured to be arranged adjacent to an exterior of the building. A façade is mounted on the structural frame. A joining frame is mounted on the structural frame of the modular building unit independently of the façade. The joining frame includes a weather-proofing interface extending along an outer perimeter of the joining frame. The weather-proofing interface is configured to engage a joining frame of at least one other modular building assembly to form a seal with said at least one other modular building assembly when the modular building assembly and at least one other modular building assembly are arranged next to one another in the building.

In another aspect, a method of forming a structural frame of a modular building unit comprises forming a structural cage at least partially defining the structural frame; forming a mounting frame separate from the structural cage; squaring the mounting frame; and attaching, after said squaring, the mounting frame to the structural cage in a positon such that the mounting frame defines an exterior side of the structural frame.

In another aspect, a mounting frame for defining an exterior side of a structural frame of a modular building unit comprises an upper structural member, a lower structural member, a first side structural member connected to the upper and lower structural members, and a second side structural member connected to the upper and lower structural members. A first connection bracket connects the upper and first side structural members together. A second connection bracket connects the upper and second side structural members together. A third connection bracket connects the lower and first side structural members together. A fourth connection bracket connects the lower and second side structural members together. The first, second, third and fourth connection brackets are constructed for interconnection for use in squaring the mounting frame.

In another aspect, a mounting frame for defining an exterior side of a structural frame of a modular building unit comprises an upper structural member, a lower structural member, a first side structural member connected to the upper and lower structural members, and a second side structural member connected to the upper and lower structural members. At least one of the upper, lower, first side or second side structural members includes a splice connection.

Other objects and features of the present disclosure will be in part apparent and in part pointed out herein.

BRIEF DESCRIPTION OF THE DRAWINGS

Corresponding reference characters indicated corresponding parts throughout the drawings.

DETAILED DESCRIPTION

Figure 1:
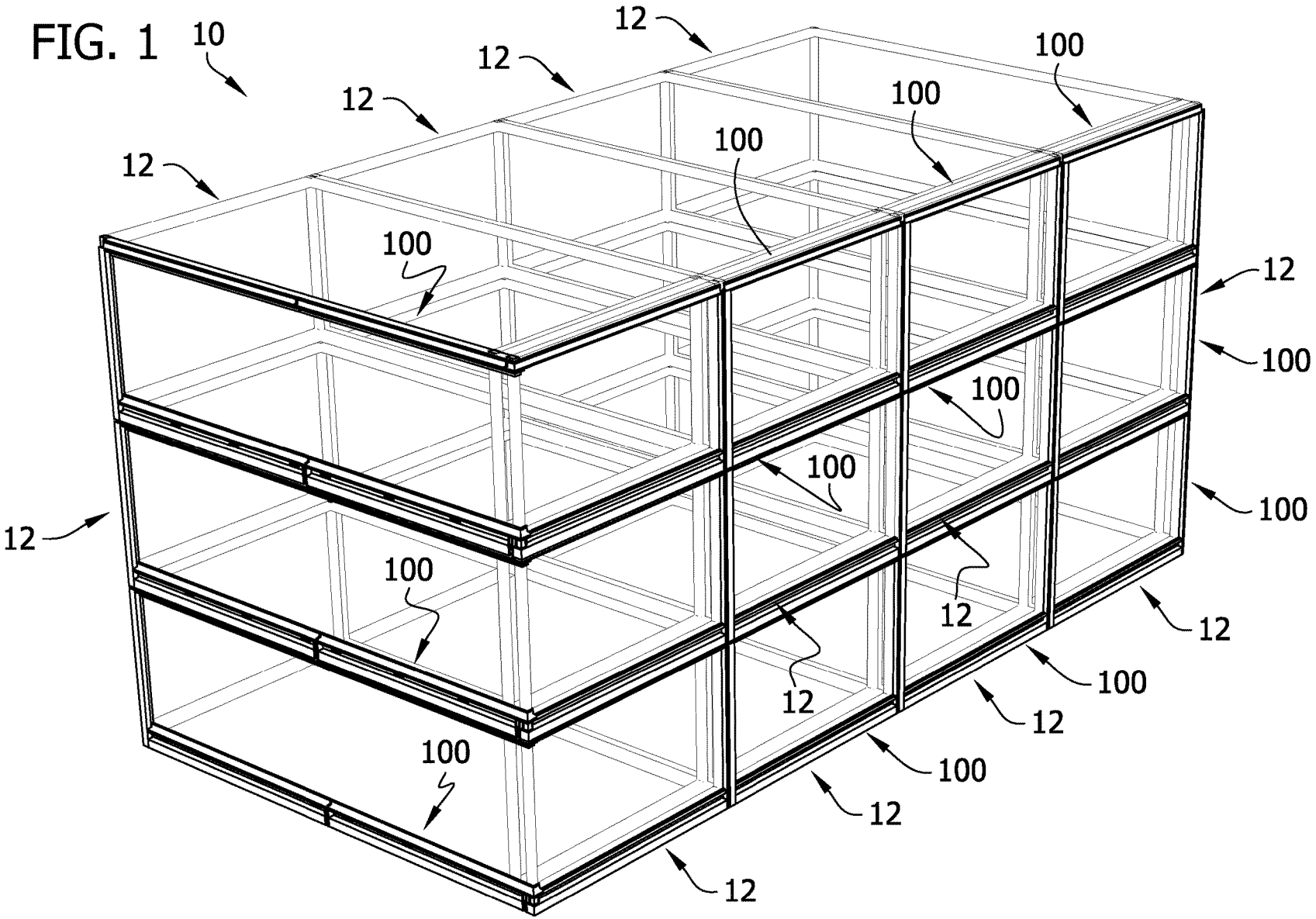
FIG. 1 is a schematic perspective of a building framework made up of modular building units and exterior joint systems according to one embodiment of the present disclosure.

Referring to FIG. 1, one embodiment of an assembled building framework (e.g., a skeleton, a frame, a steel cage, or a cage) of a building constructed according to the teachings of the present disclosure is indicated generally at reference numeral 10. The building framework 10 is made up of a plurality of modular building units 12 arranged next to one another. Each modular building unit forms a portion of the building (e.g., the building framework 10). As used herein, the building framework may refer to a substantially completed building with at least some interior finishes, to a skeleton of structural (e.g., weight bearing) members, and anything between. In the illustrated embodiment, the building framework 10 includes twelve modular building units stacked on and placed side-by-side with one another in a 3×4 grid arrangement. In other embodiments, the building framework may include more or fewer modular building units and/or other arrangements of the modular building units. Each modular building unit 12 includes a structural frame 16. The structural frames 16 may in some embodiments all be generally identical. The structural frame 16 illustrated is a rectangular parallel piped, but may have other configurations. The structural frame 16 comprises a plurality of interconnected structural members 18 (e.g., beams, posts, columns, etc.). In the illustrated embodiment, structural members 18 comprise steel HSS beams, although the structural members can have other shapes and/or comprise other materials. Each structural frame 16 may have zero, one, or multiple exterior sides depending upon the position of the modular building unit 12 in the building framework 10. A side of the structural frame 16 (broadly, the modular building unit 12) is an exterior side if the side is adjacent to an exterior of the building. In other words, a side of the structural frame 16 is an exterior side if the side is not covered up by another modular building unit 12, and is not otherwise considered to be a floor or roof of the modular building unit.

Figure 2:
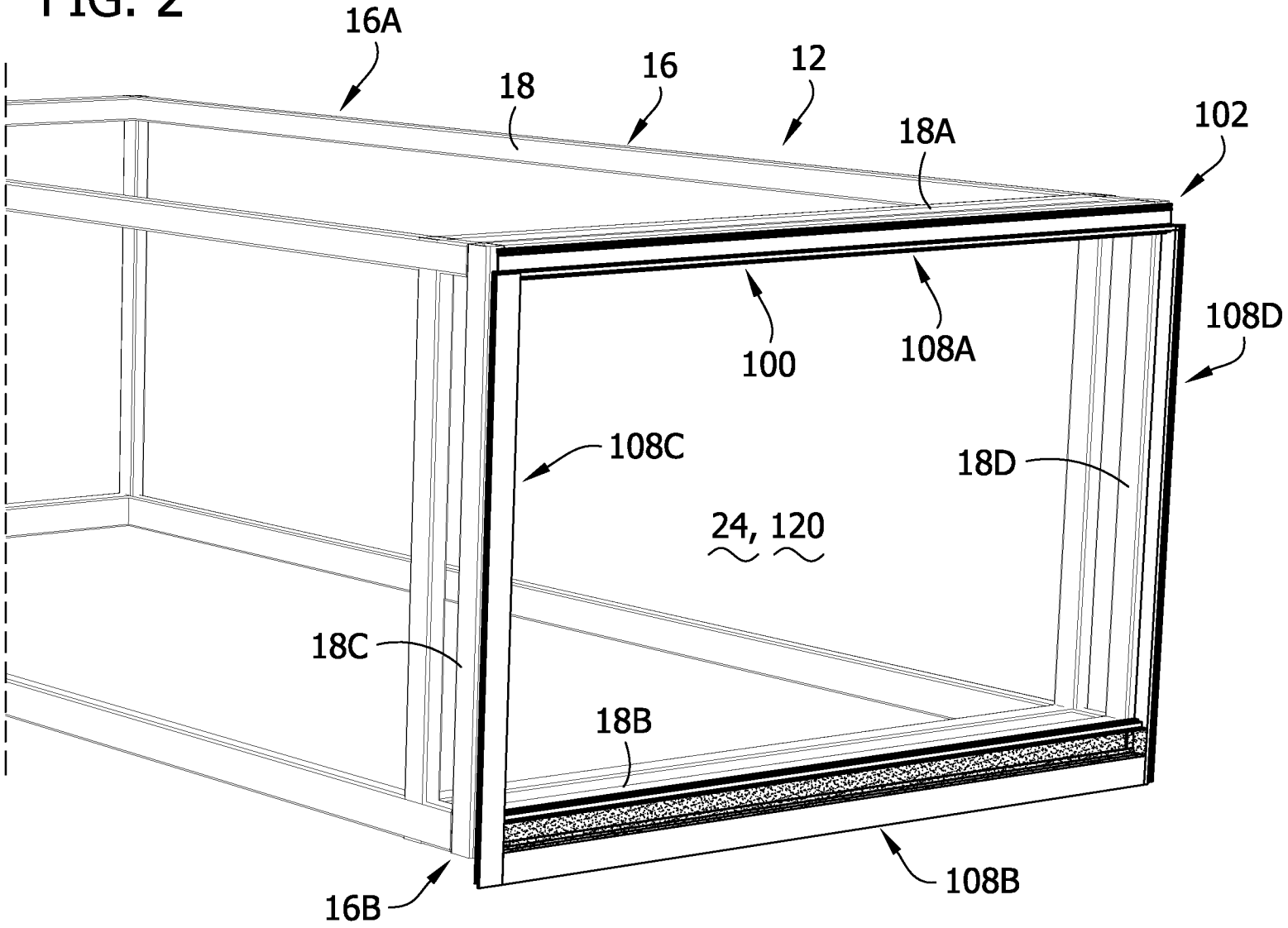
FIG. 2 is a fragmentary perspective of a modular building assembly including the modular building unit and the exterior joint system.

In the illustrated embodiment, the structural frame 16 includes a structural (e.g., steel) cage 16A and a side or mounting frame 16B (FIG. 2). The structural cage 16A comprises interconnected structural members 18 arranged to form a cuboid shape. However, it will be understood that other shapes are possible. Generally, the room or occupant space formed by the modular building unit 10 will be housed nearly entirely within the structural cage 16A. The mounting frame 16B is attached to the to the structural cage 16A and defines an exterior side of the structural frame 16. A structural frame may have more than one mounting frame 16B each defining an exterior side of the structural frame depending upon the position of the modular building unit in the building framework. In the illustrated embodiment, the exterior side of the structural frame 16 defined by the mounting frame 16B has a generally rectangular shape. The mounting frame 16B includes opposite upper and lower structural members or beams 18A, 18B and opposite first and second (e.g., left and right) side structural members or posts 18C, 18D. The upper and lower structural members 18A, 18B extend between and interconnect the first and second side structural members 18C, 18D. In the illustrated embodiment, the upper and lower structural members 18A, 18B are generally horizontal (broadly, parallel to one another) and the first and second side structural members 18C, 18D are generally vertical (broadly, parallel to one another and orthogonal to the upper and lower structural members). Thus the structural members 18A-D form a generally rectangular face of the exterior side. Further details and features of the mounting frame 16B are described below. The exterior side of the modular building unit 12 (e.g., the structural frame 16) includes an exterior opening 24. In the illustrated embodiment, the exterior opening 24 is defined by the upper, lower, first side and second side structural members 18A-D of the mounting frame 16B. The structural cage 16A also includes an opening generally aligned with and corresponding to the exterior opening 24. The exterior opening 24 receives a facade section 22 (FIG. 14) of a facade of the building (broadly, a portion of the facade). Other configurations of the exterior side are within the scope of the present disclosure. The modular building unit 12 may include fire-proofing 20 (e.g., see, FIG. 3), such as fire-resistant sheathing, that surrounds the structural members 18. The fire-proofing 20 may be considered part of the structural frame 16.

Referring to FIGS. 1-5, one embodiment of an exterior joint system or a joining frame for the modular building unit 12 is indicated generally at reference numeral 100. The exterior joint system 100 attaches to the exterior side of the modular building unit 12 and forms a seal with the other exterior joint systems mounted on attached to adjacent modular building units to prevent the ingress of moisture, vapor, debris and other outside environmental factors into the building. The exterior joint system 100 may be referred to as a picture-frame joint system as it generally forms a picture-frame type arrangement that borders the exterior side of the modular building unit 12, as shown in FIGS. 1 and 2. The exterior joint system 100 is mounted on the structural frame 16 of the modular building unit 12, specifically on the structural members 18A-D of mounting frame 16B. The exterior joint system 100 assures squareness and alignment of facades mounted on the modular building units 12. In some embodiments, structural frame 16 may not include the mounting frame 16B, in which case the exterior joint system 100 will be mounted on the structural cage 16A (in generally the same manner the exterior joint system is mount to the mounting frame). In some embodiments, the exterior joint system may have a portion mounted on the structural cage 16A and a portion mounted on the mounting frame 16B, such as when the modular building unit 12 is forming an exterior corner of a building as shown in FIG. 1. Collectively, the modular building unit 12 and exterior joint system 100 mounted thereon may be considered a modular building assembly. The exterior joint system 100, alone with other exterior joint systems, forms part of the exterior wall of the building 10. The exterior joint systems 100 of the building are constructed to engage each other to create a seal generally at the interface of adjacent modular building units 12. The exterior joint systems 100 have a size and shape that generally corresponds to the size and shape of the exterior sides of the modular building units 12. As shown in FIG. 1, the illustrated exterior joint systems 100 have a generally rectangular shape so as to correspond to the grid arrangement (e.g., columns and rows) the modular building units 12 are placed in to form the building framework 10. Other shapes of the exterior joint system are within the scope of the present disclosure. Generally, an exterior joint system 100 will be mounted to each exterior side of the modular building unit 12 (e.g., structural frame). Accordingly, more than one exterior joint system 100 may be attached to the modular building unit 12 depending upon that modular building unit's placement in the building framework 10. In addition, should the modular building unit 12 include two abutting exterior sides at a corner, the exterior joint system 100 can be configured to extend around the corner (as shown in FIG. 1).

In one method of construction, the exterior joint systems 100 are attached to the modular building units 10 off-site and brought to the construction site, where they engage other exterior joint systems when the modular building unit is arranged in the building framework 10. In another method of construction, the exterior joint systems 100 are attached to the modular building units on-site (e.g., at the construction site of the building). This can be done before the modular building unit 12 is arranged in the building framework 10 or after the modular building unit is arranged in the building framework. Regardless of the particular method of construction, the exterior joint system 100 greatly reduces the cost and time required to form a weather/outside environmental seal at the exterior of the building framework 10 between adjacent modular building units 12. For purposes of clarity, the following description refers to one of the exterior joint systems 100, with the understanding that the teachings apply equally to the other exterior joint systems.

The exterior joint system 100 is configured to border or extend along the outer perimeter or periphery of the exterior side of the modular building unit 10. As illustrated in FIGS. 1 and 2, the exterior joint system 100 is disposed on the exterior (e.g., in front or to the outside) of the exterior side of the structural frame 16 when the exterior joint system is mounted on or secured to the exterior side of the structural frame. The exterior joint system 100 has an overall height and/or width that may be larger than the height and/or width of the modular building unit 12, and may extend above (not shown) or below the cage 16A. This can enable the exterior joint system 100, mounted on the exterior side of the structural frame 18, to engage (e.g., mate) with other exterior joint systems to form a seal between the exterior joint systems, as described in more detail below.

Figure 3:
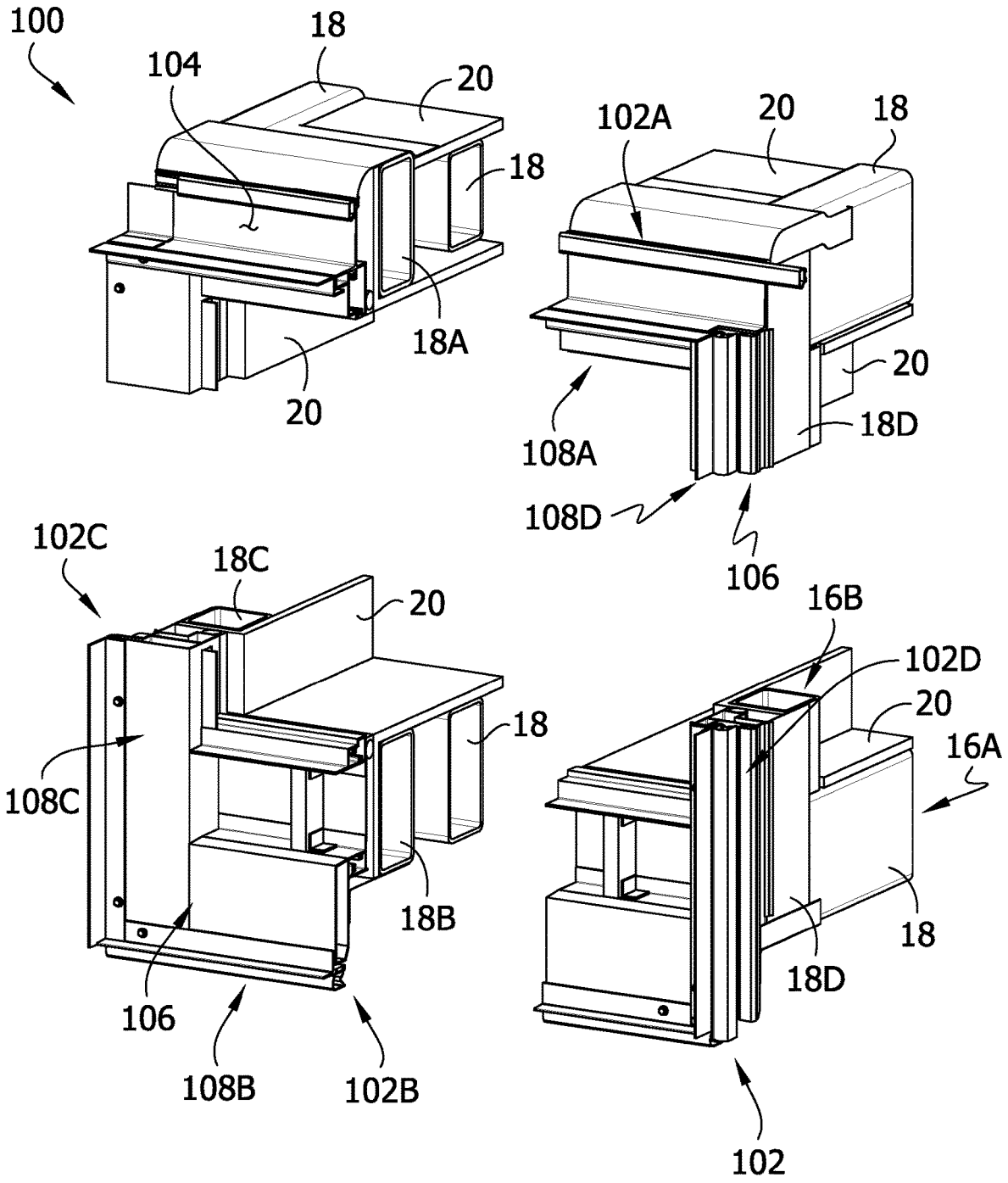
FIG. 3 is a front perspective of the exterior joint system attached to the modular building unit, the exterior joint system and the modular building unit shown broken horizontally and vertically (corresponding horizontal and vertical break lines not shown)
Figure 4:
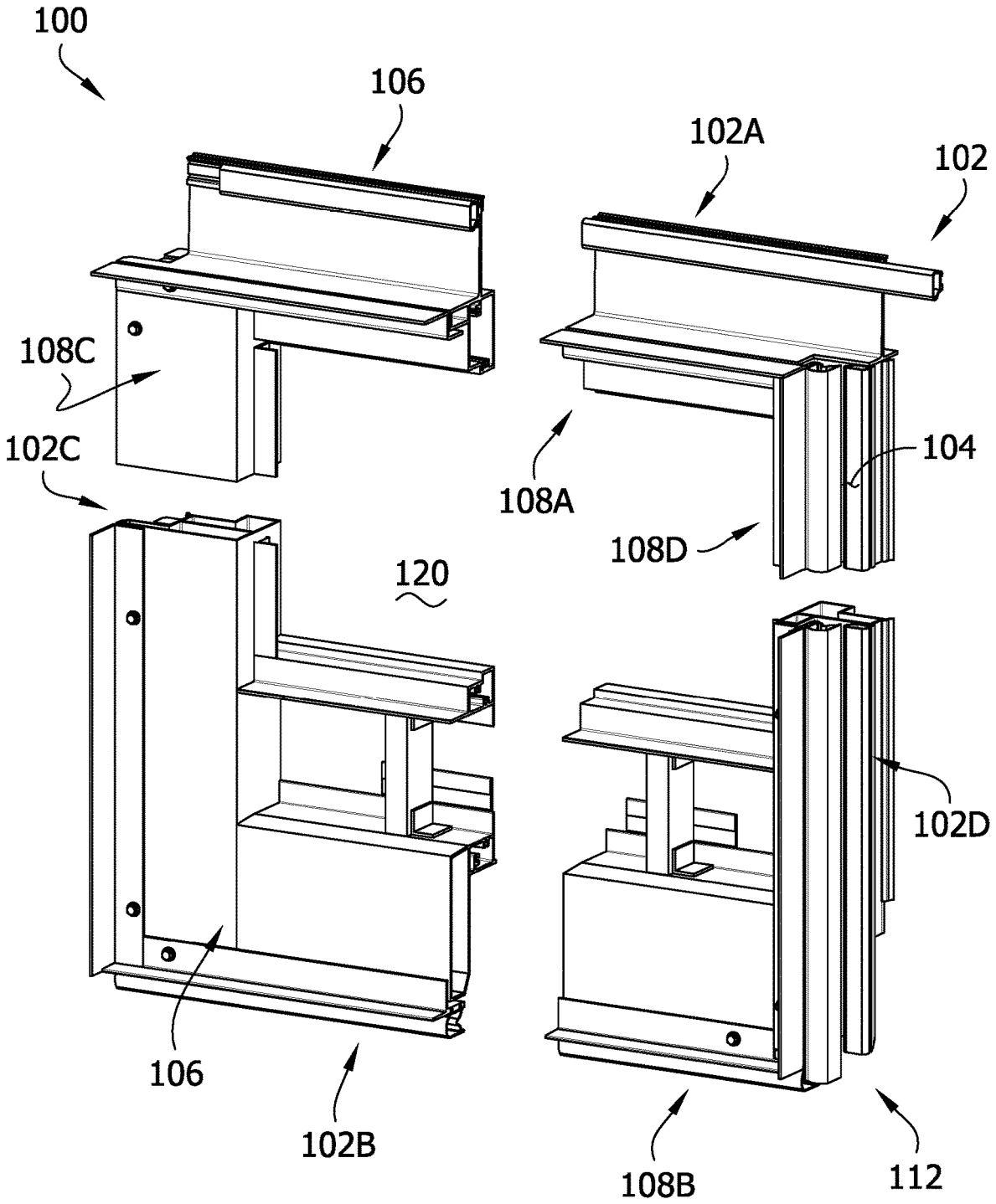
FIG. 4 is a front perspective of the exterior joint system, the exterior joint system shown broken horizontally and vertically (corresponding horizontal and vertical break lines not shown)
Figure 5:
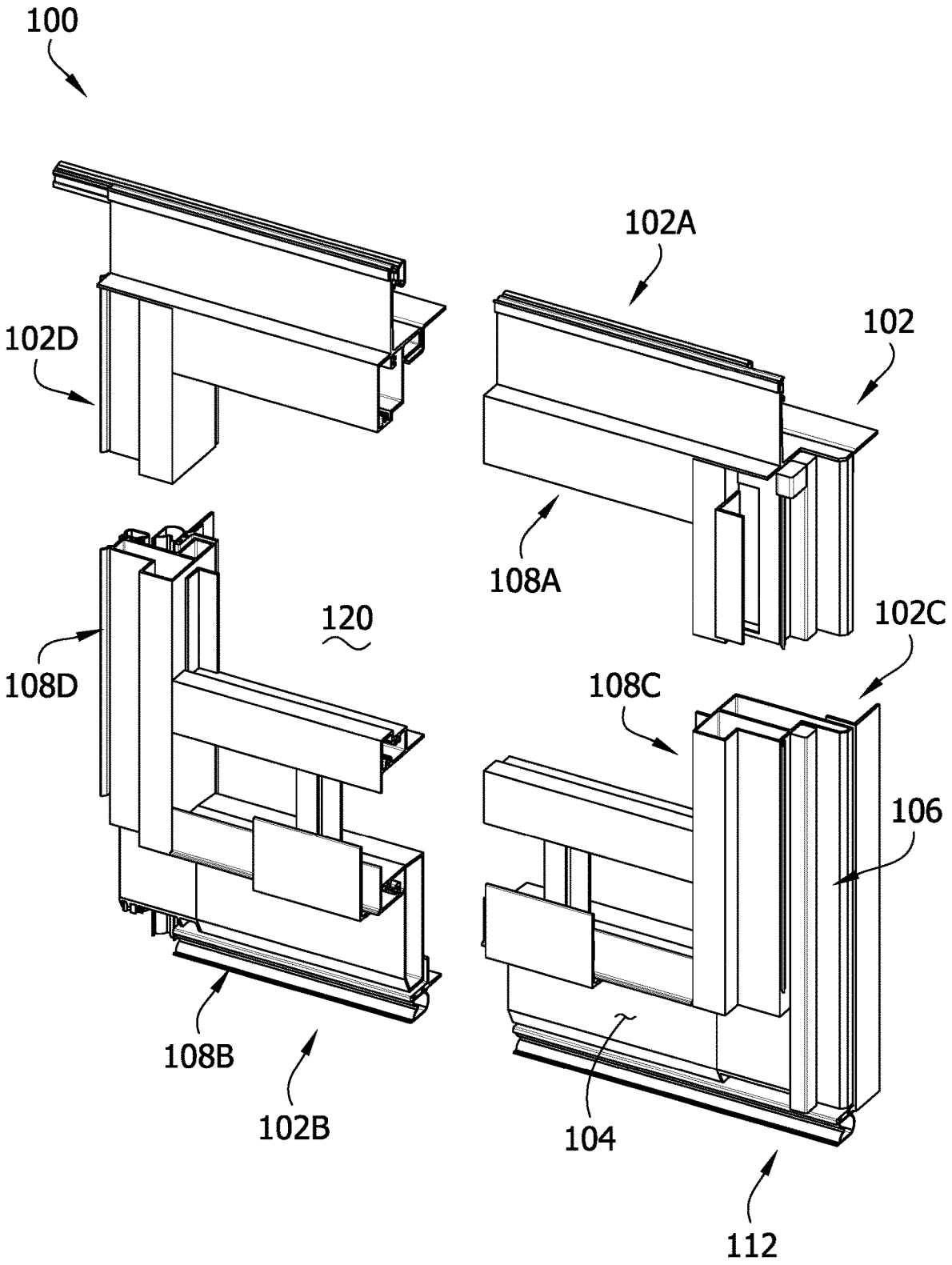
FIG. 5 is a rear perspective thereof.

Referring to FIGS. 3-5, the exterior joint system 100 includes a weather-proofing interface 102 extending along an outer perimeter of the exterior joint system. As will become apparent, the weather-proofing interface 102 of the exterior joint system 100 forms a seal (e.g., a fluid and/or moisture/vapor tight seal) with the weather-proofing interface of adjacent exterior joint systems (broadly, at least one other exterior joint system) when modular building assemblies are arranged in the building framework 10. In general, and explained in more detail below, the weather-proofing interface 102 of the exterior joint system 100 engages (e.g., mates with) the weather-proofing interfaces of the other exterior joint systems to form the seal between the exterior joint systems (broadly, the modular building assemblies). It is understood that the weather-proofing interface 102 can form seals with other components of the building besides other exterior joint systems 100, such as roofs or foundations. For instance, in one embodiment, the building component includes similar structure to the weather-proofing interface so that the weather-proofing interface 102 of the exterior joint system 100 can engage and form a seal between the building component and the exterior joint system.

In one embodiment, the weather-proofing interface 102 extends along a majority of the entire outer perimeter of the exterior joint system 100. Preferably, the weather-proofing interface 102 extends along generally the entire perimeter, and, even more preferably, along the entire perimeter (e.g., the weather-proofing interface 102 is sufficiently continuous in extent so a seal is formed continuously along the entire outer perimeter). In the illustrated embodiment, the interlocking structure 102 is generally defines the outer perimeter of the exterior joint system 100. When the exterior joint system 100 is attached to the modular building unit 12, the weather-proofing interface 102 extends along a majority of the outer perimeter of the exterior side of the structural frame 16, preferably along generally the entire perimeter of the exterior side, and more preferably along the entire perimeter of the exterior side.

The weather-proofing interface 102 is arranged to overlap the adjacent exterior joint systems. Overlapping of the weather-proofing interfaces 102 creates an isolated and deliberate void of air that inhibits the formation of any linear ingress paths for fluid, moisture and/or vapor to penetrate the seal (e.g., double seal) between the weather-proof interfaces. Instead, due to the overlapping, any potential ingress path with in the void includes at least one turn (e.g., 90 degree turn), making it much harder for any fluid, moisture and/or vapor to penetrate the seal. In other words, the overlapping makes the formed seal between the weather-proofing interfaces 102 more robust. In the illustrated embodiment, the weather-proofing interface 102 includes a recess or pocket 104 (broadly, at least one recess or pocket) and a projection or lip 106 (broadly, at least one projection or lip). Broadly, the weather-proofing interface 102 includes at least one of the recess 104 and the lip 106. The lip is arranged to extend into a recess 104 of the weather-proofing interface 102 of an adjacent exterior joint system to form the seal. Likewise, the recess 104 is sized and shaped to receive a lip 106 of the weather-proofing interface 102 of an adjacent exterior joint system to form the seal. It is understood that in other embodiments, the weather-proofing interface 102 may include other types of structural components that form a seal between exterior joint systems 100.

The weather-proofing interface 102 comprises segments or sections, which themselves may be referred to as just weather-proofing interfaces. In the illustrated embodiment, the weather-proofing interface 102 includes an upper or first weather-proofing interface 102A, a lower or second weather-proofing interface 102B, a left (e.g., first) side or third weather-proofing interface 102C, and a right (e.g., second) side or fourth weather-proofing interface 102D. The first weather-proofing interface 102A is arranged to extend along the upper portion of the exterior side of the structural frame 16 (e.g., the upper structural member 18A), the second weather-proofing interface 102B is arranged to extend along the lower portion of the exterior side of the structural frame (e.g., the lower structural member 18B), the third weather-proofing interface 102C is arranged to extend along the left or first side portion of the exterior side of the structural frame (e.g., the first side structural member 18C), and the fourth weather-proofing interface 102D is arranged to extend along the right or second side portion of the exterior side of the structural frame (e.g., the second side structural member 18D). Accordingly, the combination of the first, second, third, and fourth weather-proofing interfaces 102A-D extend along the entire perimeter of the exterior side of the structural frame 16. In general, the weather-proofing interface 102 includes four segments or sections, each one on a side (e.g., portion or segment of the outer perimeter) of the exterior joint system 100 and extending substantially continuously along the length of the corresponding side. In the illustrated embodiment, each of the first, second, third, and fourth weather-proofing interfaces 102A-D includes a recess 104 and a lip 106 (broadly, at least one of the recess and the lip). The number of weather-proofing sections may be other than shown and described herein and their constructions may differ from the embodiment shown and described. For example and without limitation, the recess and the lip may change positions.

In the illustrated embodiment, the weather-proofing interface 102 includes generally two interface types—i.e., a first interface type and a second interface type (e.g., corresponding or mating interface types)—depending on the relative positions of the recess 104 and lip 106 relative to one another. The recess 104 is disposed in front of or toward the outside of the lip 106 in the first interface type. In particular, in the first interface type, the lip 106 defines the rear (e.g., rear side) of the recess. In the first interface type, the recess 104 has an open front (FIG. 6) and is arranged to receive the lip 106 of the second interface type. For the second interface type, the lip 106 is disposed in front of or toward the outside of the recess 104. In particular, in the second interface type, the lip 106 defines the front (e.g., front side) of the recess 104 (FIG. 7). In the second interface type, the recess 104 has an open rear (e.g., rear side) and is arranged to receive the lip of the first interface type. The first interface type of one weather-proofing interface 102 of one exterior joint system 100 forms the seal with the second interface type of the weather-proofing interface of an adjacent joint system. Likewise, the second interface type of one weather-proofing interface 102 of one exterior joint system 100 forms the seal with the first interface type of the weather-proofing interface of an adjacent joint system. It is noted that the seal is achieved simply by the engagement of adjacent exterior joint systems 100. No caulking or application of other material to the exterior joint systems 100 is required for sealing.

The first and second interface types of the weather-proofing interface 102 extend along different portions of the outer perimeter of the exterior joint system 100. For example, in the illustrated embodiment, the first interface type extends along the upper and right side portions of the outer perimeter and the second interface type extends along the lower and left side portions of the outer perimeter. In other words, the first and fourth weather-proofing interfaces 102A, 102D are of the first interface type and the second and third weather-proofing interfaces 102B, 102C are of the second interface type. This way, when one exterior joint system 100 is positioned in the building framework 10, the first interface type extending along the upper portion of the outer perimeter of the exterior joint system 100 mates with a second interface type extending along a lower portion of the outer perimeter of another exterior joint system disposed above the one exterior joint system. The first interface type extending along the right side portion of the outer perimeter of the exterior joint system 100 mates with a second interface type extending along a left side portion of the outer perimeter of another exterior joint system disposed to the right of the one exterior joint system. Similarly, the second interface type extending along the lower portion of the outer perimeter of the one exterior joint system 100 mates with a first interface type extending along an upper portion of the outer perimeter of still another exterior joint system disposed below the one exterior joint system, and the second interface type extending along the left side portion of the outer perimeter of the one exterior joint system mates with a first interface type extending along a right side portion of the outer perimeter of still another exterior joint system disposed to the left of the one exterior joint system. Other configurations of the interface types are within the scope of the present disclosure. For example, one interface type may have the lip and no recess and the other interface type may have the recess but no lip.

The weather-proofing interface 102 of the present disclosure may be generally described as having a lip 106 (broadly, one interface type) extending along a portion of the outer perimeter of the exterior joint system 100 and a recess 104 (broadly, the other interface type) extending along another portion of the outer perimeter. The portion of the outer perimeter the lip 106 extends along is a lower portion and a first side portion of the perimeter or the upper portion and second side portion of the perimeter and the portion of the outer perimeter the recess 104 extends along is the other of the lower portion and first side portion or the upper portion and second side portion. Such configurations of the weather-proofing interface 102 allows identical adjacent exterior joint systems 100 to engage each other and form the seals when position in the building framework. In another example, the weather-proofing interface 102 of one exterior joint system 100 may only include the first interface type and the weather-proofing interface of another exterior joint system may only include the second interface type. In this example, the first interface type of one exterior joint system will mate with the second interface type of the adjacent exterior joint systems. In other embodiments, the first and fourth weather-proofing interfaces 102A, 102D are of the second interface type and the second and third weather-proofing interfaces 102B, 102C are of the first interface type.

The weather-proofing interface 102 includes at least one weather strip 112 (broadly, a resiliently compressible, deflectable or deformable member) arranged to engage the other, adjacent exterior joint systems to facilitate the formation of the seal between exterior joint systems. One or more of the first, second, third, and fourth weather-proofing interfaces 102A-D may include one or more weather-strips 112. In one embodiment, the weather strips 112 each comprise a resiliently compressible and conformable bulb gasket (e.g., a silicone bulb gasket). The weather strip is resistant to the passage of water, water vapor and other debris (particularly fluidizable debris). Each weather strip 112 is arranged to engage at least one of the other, adjacent exterior joint systems to facilitate the formation of the seal between the exterior joint systems.

Figure 6:
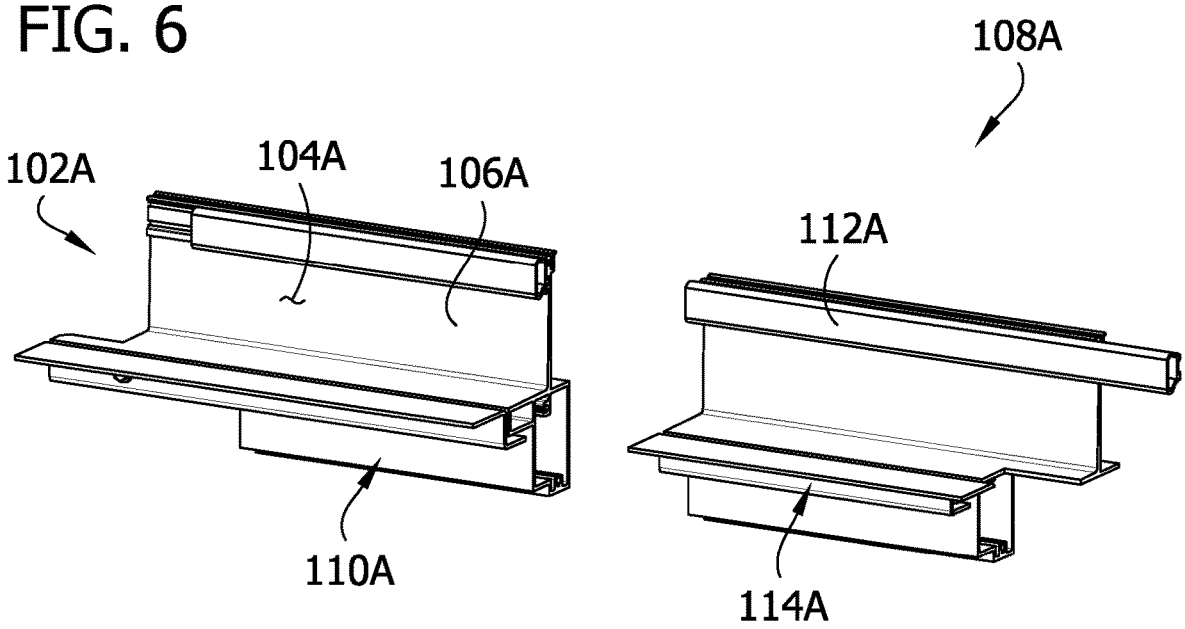
FIG. 6 is a fragmentary, front perspective of a first frame member of the exterior joint system.
Figure 7:
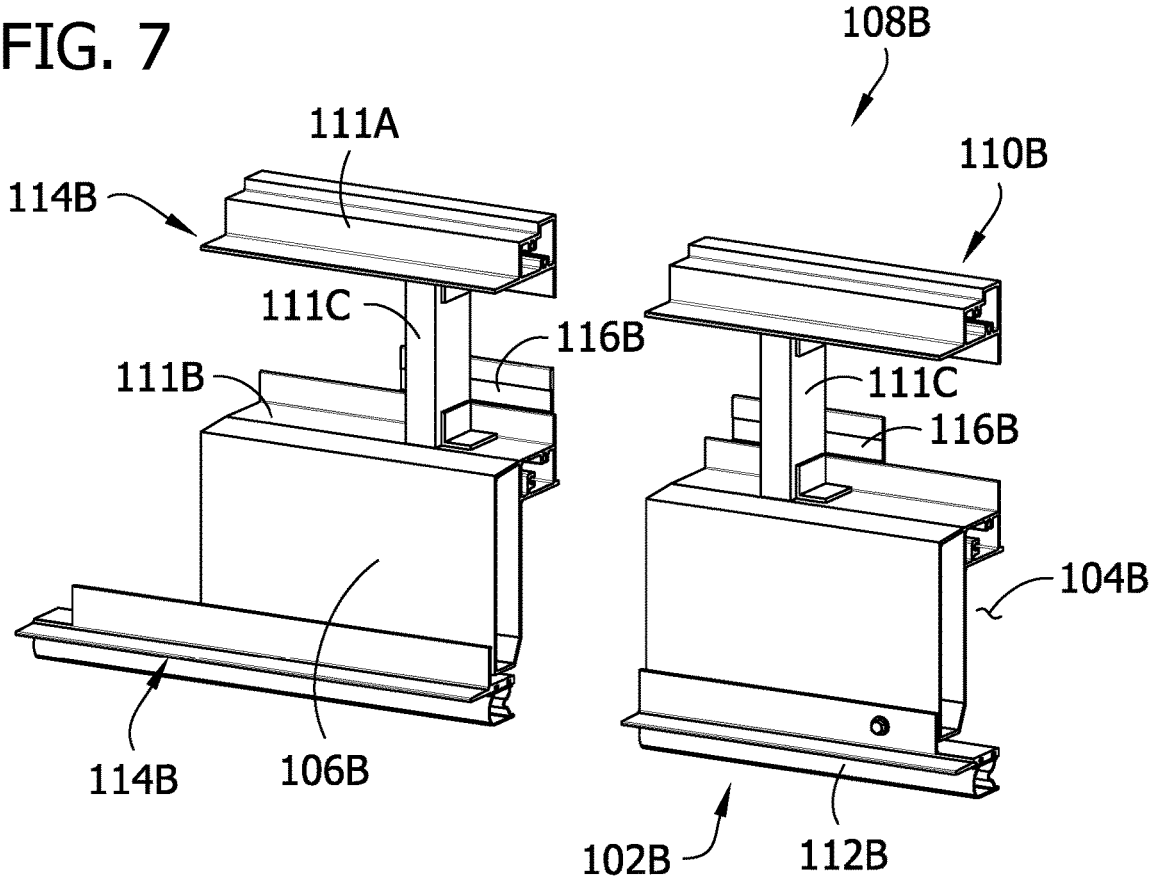
FIG. 7 is a fragmentary, front perspective of a second frame member of the exterior joint system.

Referring to FIGS. 2 and 6-9, the exterior joint system 100 includes a plurality of frame members 108. The frame members can be mounted on a first modular building unit 12. In the illustrated embodiment, the exterior joint system 100 includes an upper frame member 108A, a lower frame member 108B, a first side frame member 108C, and a second side frame member 108D. Referring to FIG. 6, the upper frame member 108A is elongate and has a length that corresponds to the length of the upper portion of the exterior side of the structural frame 16. It is understood the upper frame member 108A can be of generally any length. The upper frame member 108A includes an elongate body or base 110A. The upper frame member 108A includes the first weather-proofing interface 102A of the weather-proofing interface 102 and, as mentioned above, the first weather-proofing interface is of the first interface type. The first weather-proofing interface 102A of this "first" exterior joint system is configured to engage a second exterior joint system (e.g., a weather-proofing interface thereof) of a second modular building unit (not shown) to form a seal with the second exterior joint system when the first modular building unit is positioned adjacent to the second modular building unit. The first weather-proofing interface 102A is configured to vertically overlap the second exterior joint system. For the first weather-proofing interface 102A, the projection or lip 106A of the upper frame member 108A extends generally upward from an upper surface of the base 110A. The lip 106A is adjacent the rear of the base 110A. The upper frame member 108A defines the recess or pocket 104A. The base 110A generally defines the bottom of the recess 104A and the lip 106A defines the rear of the recess. The recess 104A has an open front and an open top. The open top of the recess 104A is arranged to face generally upward when the upper frame member 108A is attached to the modular building unit 12 to receive a lip of the second exterior joint system.

The upper frame member 108A is configured to be attached to the upper structural member 18A of the modular building unit 12. The upper frame member 108A may include one or more mounting brackets (not shown) used to attach the upper frame member to the upper structural member 18A. In one embodiment, self-tapping or self-drilling fasteners (e.g., self-drilling screws) may be used to attach the mounting bracket to the base 110A and the mounting bracket to the upper structural member 18A to mount the upper frame member 108A to the upper structural member. In the illustrated embodiment, the end portions of the upper frame member 108A (e.g., the end portions of the base 110A and/or lip 106A) are notched to permit the upper frame member to receive corresponding end portions of the first and second side frame members 108C, 108D when the frame members are mounted on the structural frame 16 of the modular building unit 12. The upper frame member 108A may also include one or more attachment points 114A (e.g., attachment flanges) that can be used to connect other elements, such as facade elements, to the upper frame member 108A.

In the illustrated embodiment, the first weather-proofing interface 102A also includes a weather strip 112A (e.g., a first weather strip). The weather strip 112A is disposed in the recess 104A and is arranged to engage the other first exterior joint system. Specifically, the weather strip 112A is arranged to engage a lip 106B of the other first exterior joint system when the lip extends into the recess 104A of the first weather-proofing interface 102A. The weather strip 112A is mounted to the front side of the lip 106A, adjacent the free end of the lip. The weather strip 112A extends substantially continuously along generally the entire length of the lip 106A. The weather strip 112A has an engagement portion that projects into the recess 104A to be engaged by the lip 106B of the other first exterior joint system. In the illustrated embodiment, one end portion of the weather strip 112A extends past and overhangs one end of the lip 106A. This extension of the weather strip 112A helps facilitate the formation of the seal with the other exterior joint systems. In one embodiment, the weather strip 112A has thickness of about 1 inch (about 2.5 cm), while in other embodiments, the thickness may vary provided that the weather strip 112A suitably facilitates the formation of the seal.

The components (e.g., the base 110A, the lip 106A) of the upper frame member 108A are preferably made from (e.g., comprise) a rigid material such as metal, plastic, or any other suitable material. For example, in the illustrated embodiment, the base 110A and the lip 106A are made from a single piece of extruded aluminum.

Referring to FIG. 7, the lower frame member 108B is elongate and has a length that corresponds to the length of the lower portion of the exterior side of the structural frame 16. It is understood the lower frame member 108B can be of generally any length. The lower frame member 108B includes an elongate body or base 110B. In the illustrated embodiment, the base 110B includes an upper base member 111A, a lower base member 111B and a plurality of studs 111C interconnecting the upper and lower base members. Other configurations of the base 110B are within the scope of the present disclosure. The lower frame member 108B includes the second weather-proofing interface 102B of the weather-proofing interface 102 and, as mentioned above, the second weather-proofing interface is of the second interface type. The second weather-proofing interface 102B is configured to engage a second exterior joint system (e.g., a weather-proofing interface thereof) of a second modular building unit to form a seal with said second exterior joint system when the lower frame member 108B is attached to the first modular building unit 12 and the modular building unit is positioned adjacent the second modular building unit. The second weather-proofing interface 102B is configured to vertically overlap the second exterior joint system. For the second weather-proofing interface 102B, the projection or lip 106B of the lower frame member 108B extends generally downward from a lower surface of the base 110B (e.g., the lower base member 111B). In the illustrated embodiment, the lip 106B extends below the lower structural member 18B in order to overlap with the exterior joint system of a modular building unit disposed directly below in the framework. The lip 106B is adjacent the front of the base 110B. The lower frame member 108B defines the recess or pocket 104B. The base 110B generally defines the top of the recess 104B and the lip 106B defines the front of the recess. The recess 104B has an open bottom and an open rear. The open bottom of the recess 104B is arranged to face generally downward when the lower frame member 108B is attached to the modular building unit 12 to receive a lip of the second exterior joint system.

Figure 10:
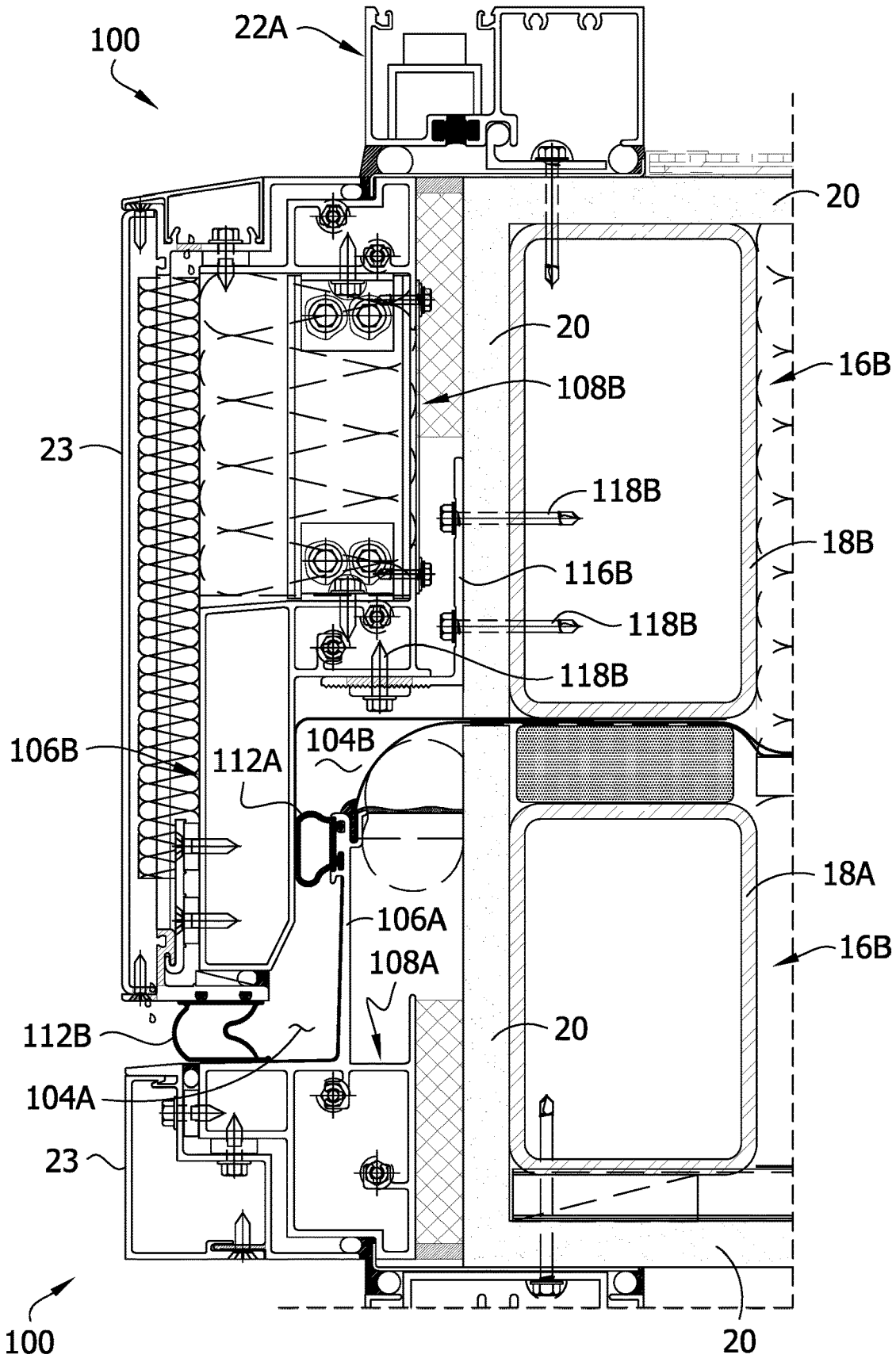
FIG. 10 is an enlarged, fragmentary vertical section showing a horizontal intersection between two modular building assemblies.

The lower frame member 108B is configured to be attached to the lower structural member 18B of the modular building unit 12. The lower frame member 108B may include one or more mounting brackets 116B used to attach the lower frame member to the lower structural member 18B. In one embodiment, self-tapping or self-drilling fasteners 118B (e.g., self-drilling screws) may be used to attach the mounting bracket 116B to the base 110B and the mounting bracket to the lower structural member 18B to mount the lower frame member 108B to the lower structural member (FIG. 10). In the illustrated embodiment, the end portions of the lower frame member 108B (e.g., the end portions of the base 110B and/or lip 106B) are notched to permit the lower frame member to receive corresponding end portions of the first and second side frame members 108C, 108D when the frame members are mounted to the structural frame 16 of the modular building unit 12. The lower frame member 108B may also include one or more attachment points 114B (e.g., attachment flanges) that can be used to connect other elements, such as facade elements, to the lower frame member 108B.

In the illustrated embodiment, the second weather-proofing interface 102B also includes a weather strip 112B (e.g., a second weather strip). The weather strip 112B is disposed at the lower end of the lip 106B and is arranged to engage the second exterior joint system of the second modular building unit. Specifically, the weather strip 112B is arranged to engage the base 110A of the second exterior joint system when the lip 106B extends into the recess 104A of the first weather-proofing interface 102A of the second exterior joint system. The weather strip 112B extends substantially continuously along generally the entire length of the lip 106B. The weather strip 112B has an engagement portion that projects generally downward to engage the other second exterior joint system. Preferably, the weather strip 112B has a thickness (e.g., height), when at rest and in an uncompressed state, of at least about 1.5 inches (about 3.8 cm). Such a configuration allows the weather strip 112B to accommodate large tolerance variations (vertical tolerance variations) and movement (e.g., vertical movement) between modular building units 12 as the modular building units are being arranged in the building framework 10.

The components (e.g., the base 110B, the lip 106B) of the lower frame member 108B are preferably made from (e.g., comprise) a rigid material such as metal, plastic, or any other suitable material. For example, in the illustrated embodiment, the base 110B and the lip 106B are made from a multiple pieces of extruded aluminum.

In one embodiment, the upper and lower frame members 108A, 108B (broadly, the first and second weather proofing interfaces 102A, 102B) may be switched. In this embodiment, the upper frame member 108A is attached to the lower structural member 18B and the lower frame member 108B is attached to the upper structural member 18A. It is understood that in this arrangement the frame members would be flipped around to properly orient the respective weather-proofing interfaces. This arrangement may be desirable because it allows the lip 106B of the lower structural member to extend upward, past the upper structural member 18A in order to overlap with the exterior joint system of a modular building unit disposed directly above in the framework. This may be more desirable for transportation purposes, as it can be easier to transporting the modular building units with the exterior joint system mounted thereon when a lip of the exterior joint system extends above the structural frame instead of below the structural frame as illustrated.

Figure 8:
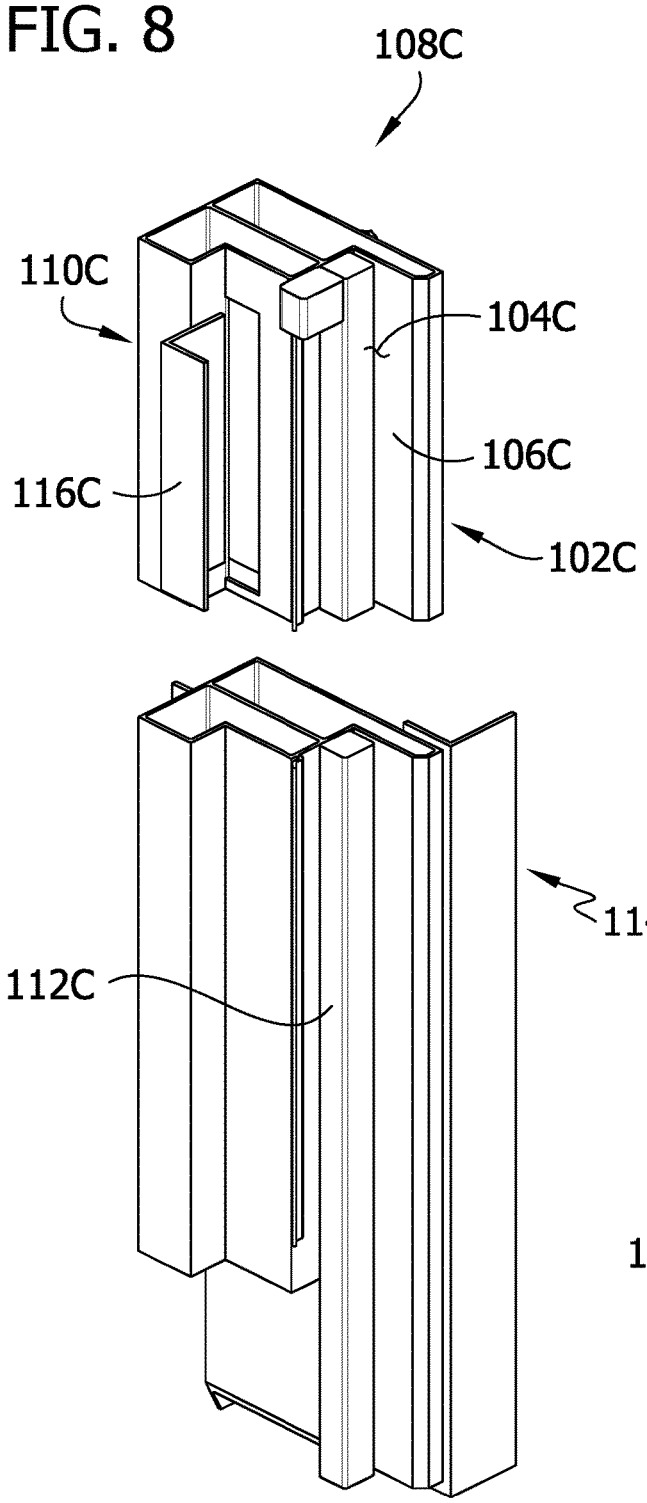
FIG. 8 is a fragmentary, rear perspective of a third frame member of the exterior joint system.

Referring to FIG. 8, the first side frame member 108C is elongate and has a length that corresponds to the length of the first side portion of the exterior side of the structural frame 16. It is understood the first side frame member 108C can be of generally any length. The first side frame member 108C includes an elongate body or base 110C. The first side frame member 108A includes the third weather-proofing interface 102C of the weather-proofing interface 102 and, as mentioned above, the third weather-proofing interface is of the second interface type. The third weather-proofing interface 102C is configured to engage a third exterior joint system (e.g., a weather-proofing interface thereof) of a third modular building unit to form a seal with the third exterior joint system when the first side frame member 108C is attached to the modular building unit 12 and the modular building unit is positioned adjacent the third modular building unit. The third weather-proofing interface 102C is configured to horizontally overlap the third exterior joint system. For the third weather-proofing interface 102C, the projection or lip 106C of the first side frame member 108C extends generally outward (e.g., leftward) from a left surface of the base 110C. The lip 106C is adjacent the front of the base 110C. The first side frame member 108C defines the recess or pocket 104C. The base 110C generally defines the right side of the recess 104C and the lip 106C defines the front of the recess. The recess 104C has an open rear and an open side (e.g., open left side). The open side of the recess 104C is arranged to face generally outward (e.g., leftward) when the first side frame member 108C is attached to the modular building unit 12 to receive a lip of the other third exterior joint system.

The first side frame member 108C is configured to be attached to the first side structural member 18C of the "first" modular building unit 12. The first side frame member 108C may include one or more mounting brackets 116C used to attach the first side frame member to the first side structural member 18C. In one embodiment, self-tapping or self-drilling fasteners 118C (e.g., self-drilling screws) may be used to attach the mounting bracket 116C to the base 110C and the mounting bracket to the first side structural member 18C to mount the first side frame member 108C to the first side structural member. In one embodiment, at least one of the end portions of the first side frame member 108C (e.g., the end portions of the base 110C and/or lip 106C) are notched to permit the first side frame member to receive corresponding end portions of the upper and lower frame members 108A, 108B when the frame members are mounted to the structural frame 16 of the modular building unit 12. The first side frame member 108C may also include one or more attachment points 114C (e.g., attachment flanges) that can be used to connect other elements, such as facade elements, to the first side frame member 108C.

In the illustrated embodiment, the third weather-proofing interface 102C includes a weather strip 112C (e.g., a third weather strip). The weather strip 112A is disposed in the recess 104C (e.g., the corner thereof) and is arranged to engage the third exterior joint system. Specifically, the weather strip 112C is arranged to engage a lip 106D of the third exterior joint system when the lip extends into the recess 104C of the third weather-proofing interface 102C. In this embodiment, the weather strip 112C comprises a resiliently compressible block (e.g., a closed cell silicone foam block). The weather strip 112C extends substantially continuously along generally the entire length of the recess 104C. In one embodiment, the weather strip 112C has a width of about 1 inch (about 2.5 cm) and a depth of about 1 inch (about 2.5 cm). After, installation, the weather strip 112C may be slightly compressed, such that it has a compressed width of about ⅞ inch (about 2.2 cm) and/or a compressed depth of about ⅞ inch (about 2.2 cm), while in other embodiments, the weather strip 112C may have other widths and depths suitable for facilitating the engagement described.

The components (e.g., the base 110C, the lip 106C) of the first side frame member 108C are preferably made from (e.g., comprise) a rigid material such as metal, plastic, or any other suitable material. For example, in the illustrated embodiment, the base 110C and the lip 106B are made from a single piece of extruded aluminum.

Figure 9:
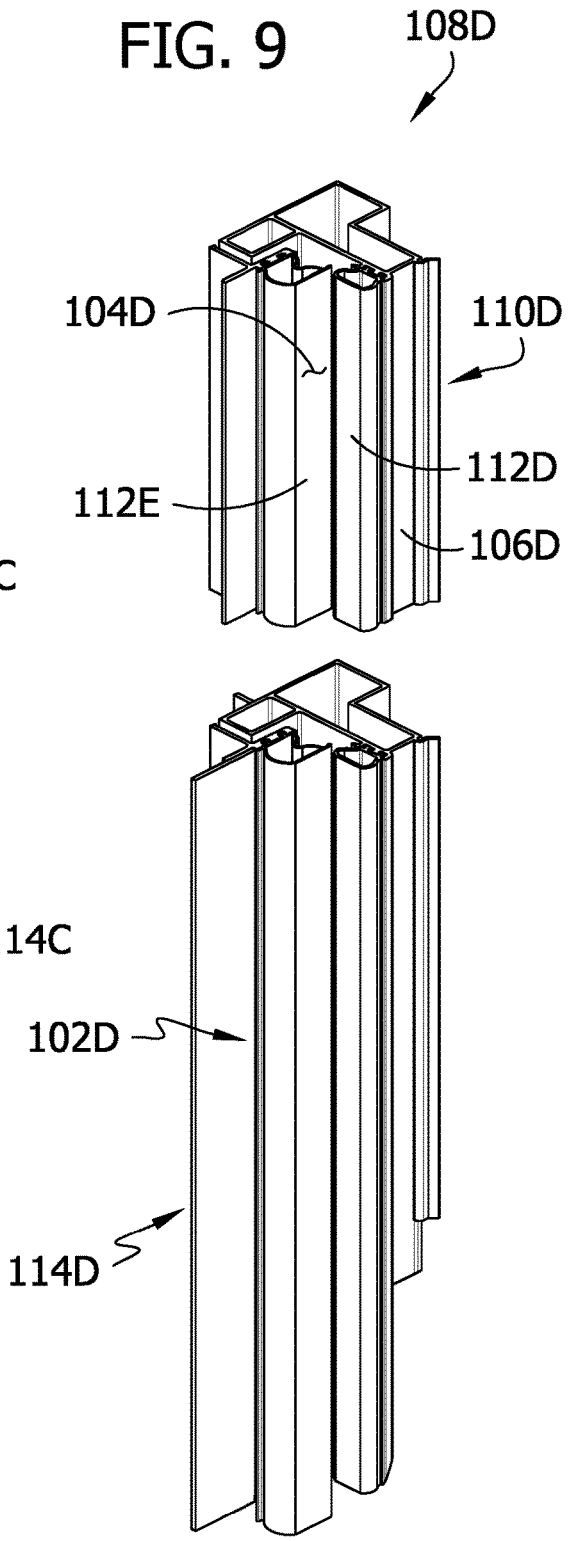
FIG. 9 is a fragmentary, front perspective of a fourth frame member of the exterior joint system.

Referring to FIG. 9, the second side frame member 108D is elongate and has a length that corresponds to the length of the second side portion of the exterior side of the structural frame 16. It is understood the second side frame member 108D can be of generally any length. The second side frame member 108D includes an elongate body or base 110D. The second side frame member 108D includes the fourth weather-proofing interface 102D of the weather-proofing interface 102 and, as mentioned above, the fourth weather-proofing interface is of the first interface type. The fourth weather-proofing interface 102D is configured to engage a fourth exterior joint system (e.g., a weather-proofing interface thereof) of a fourth modular building unit to form a seal with said fourth exterior joint system when the second side frame member 108D is attached to the modular building unit 12 and the modular building unit is positioned adjacent the fourth modular building unit. The fourth weather-proofing interface 102D is configured to horizontally overlap the fourth exterior joint system. For the fourth weather-proofing interface 102D, the projection or lip 106D of the second side frame member 108D extends generally outward (e.g., rightward) from a right side surface of the base 110D. The lip 106D is adjacent the rear of the base 110D. The first side frame member 108D defines the recess or pocket 104D. The base 110D generally defines the left side of the recess 104D and the lip 106D defines the rear of the recess. The recess 104D has an open front and an open second (e.g., right) side. The open second side of the recess 104D is arranged to face generally outward (e.g., rightward) when the first side frame member 108D is attached to the modular building unit 12 to receive a lip of the fourth exterior joint system.

The second side frame member 108D is configured to be attached to the second side structural member 18D of the modular building unit 12. The second side frame member 108D may include one or more mounting brackets 116D (FIG. 11) used to attach the upper frame member to the second side structural member 18D. In one embodiment, self-tapping or self-drilling fasteners (e.g., self-drilling screws) 118D may be used to attach the mounting bracket to the base 110D and the mounting bracket 116D to the second side structural member 18D to mount the second side frame member 108D to the upper structural member. In the illustrated embodiment, at least one of the end portions of the second side frame member 108D (e.g., the end portions of the base 110D and/or lip 106D) are notched to permit the second side frame member to receive corresponding end portions of the upper and lower frame members 108A, 108B when the frame members are mounted to the structural frame 16 of the modular building unit 12. The second side frame member 108D may also include one or more attachment points 114D (e.g., attachment flanges) that can be used to connect other elements, such as facade elements, to the second side frame member 108D.

In the illustrated embodiment, the fourth weather-proofing interface 102A also includes two weather strips 112D, 112E (e.g., fourth and fifth weather strips). The weather strips 112D, 112E are disposed in the recess 104D and are arranged to engage the fourth exterior joint system. The fourth weather strip 112D is arranged to engage a lip 106C of the fourth exterior joint system when the lip extends into the recess 104D of the fourth weather-proofing interface 102D. The weather strip 112D is mounted on the front side of the lip 106D, adjacent the free end of the lip. The weather strip 112D extends substantially continuously along generally the entire length of the lip 106D. The weather strip 112D has an engagement portion that projects into the recess 104D to be engaged by the lip 106C of the other fourth exterior joint system. The fifth weather strip 112E is disposed at the left side of the recess 104D and is arranged to engage the end of the lip 106C of the fourth exterior joint system when the lip 106C extends into the recess 104D of the fourth weather-proofing interface 102D. The fifth weather strip 112E extends substantially continuously along generally the entire length of the recess 104D. The fifth weather strip 112E has an engagement portion that projects generally outward (e.g., rightward) to engage the other fourth exterior joint system.

Preferably, the weather strip 112E has a thickness (e.g., width), when at rest and in an uncompressed state, of at least about 1.6 inches (about 4.1 cm). Such a configuration allows the fifth weather strip 112E to accommodate large tolerance variations (horizontal tolerance variations) and movement (e.g., horizontal movement) between modular building units 12 when the modular building units are arranged in the building framework 10. In one embodiment, the fourth weather strip 112D has a thickness of about 1 inch (about 2.5 cm), while in other embodiments, the fourth weather strip 112D may have varying thicknesses.

The components (e.g., the base 110D, the lip 106D) of the first side frame member 108D are preferably made from (e.g., comprise) a rigid material such as metal, plastic, or any other suitable material. For example, in the illustrated embodiment, the base 110D and the lip 106D are made from a single piece of extruded aluminum.

As is apparent, the first and second interface types have slightly different configurations depending on what frame member 108A-D the interface type is a part of. Still, each configuration of the first and second interface types have generally the same features, as described above. However, depending on what frame member 108A-D the interface types are a part of, the interface types may have some additional features.

In one embodiment, the first and second side frame members 108C, 108D (broadly, the third and fourth weather proofing interfaces 102C, 102D,) may be switched. In this embodiment, the first side frame member 108C is attached to the second side structural member 18D and the second side frame member 108D is attached to the first side structural member 18C. It is understood that in this arrangement the frame members would be flipped around to properly orient the respective weather-proofing interfaces. In one embodiment, an installer may simply rotate the entire exterior joint system 100 180-degrees from the orientation shown in the figures (see FIG. 2) around the exterior face of the structural frame 16 to switch all of the frame members 108A-D.

Figure 12A:
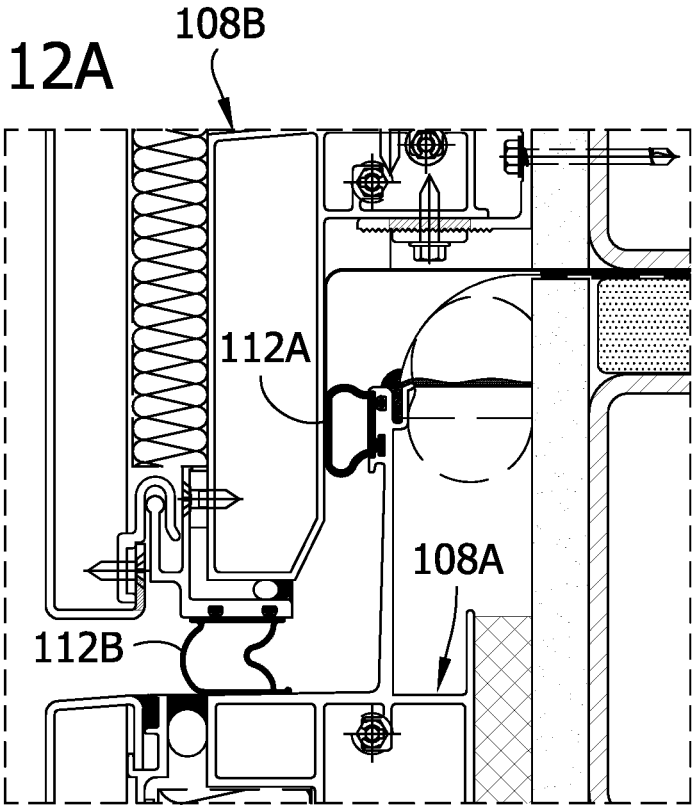
FIG. 12A is similar to FIG. 10 and illustrates the horizontal intersection in a nominal state.
Figure 12B:
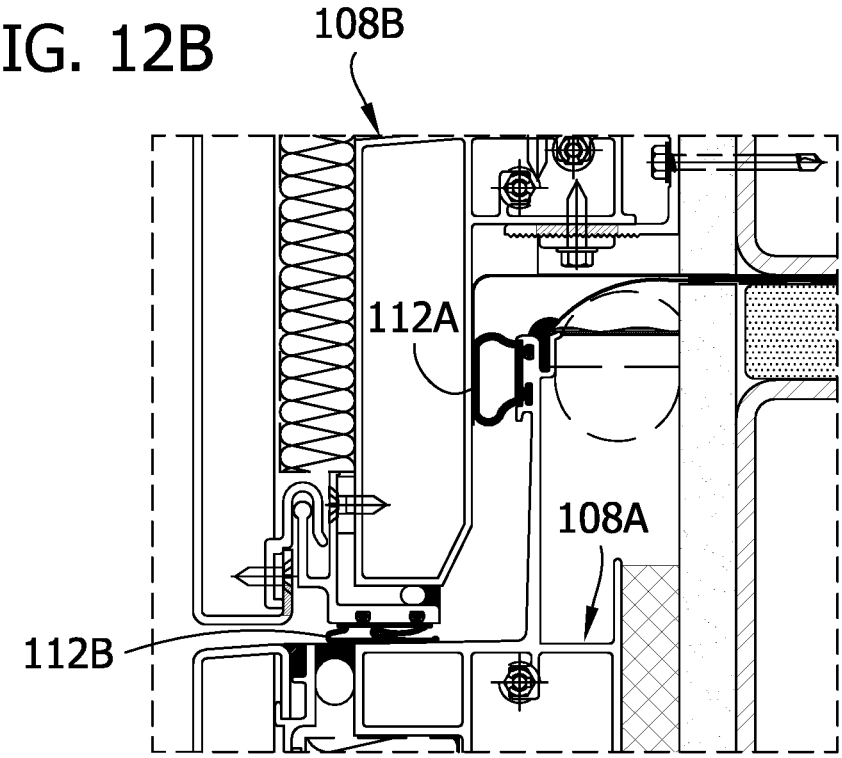
FIG. 12B is similar to FIG. 12A but illustrates the horizontal intersection in a compressed state.
Figure 12C:
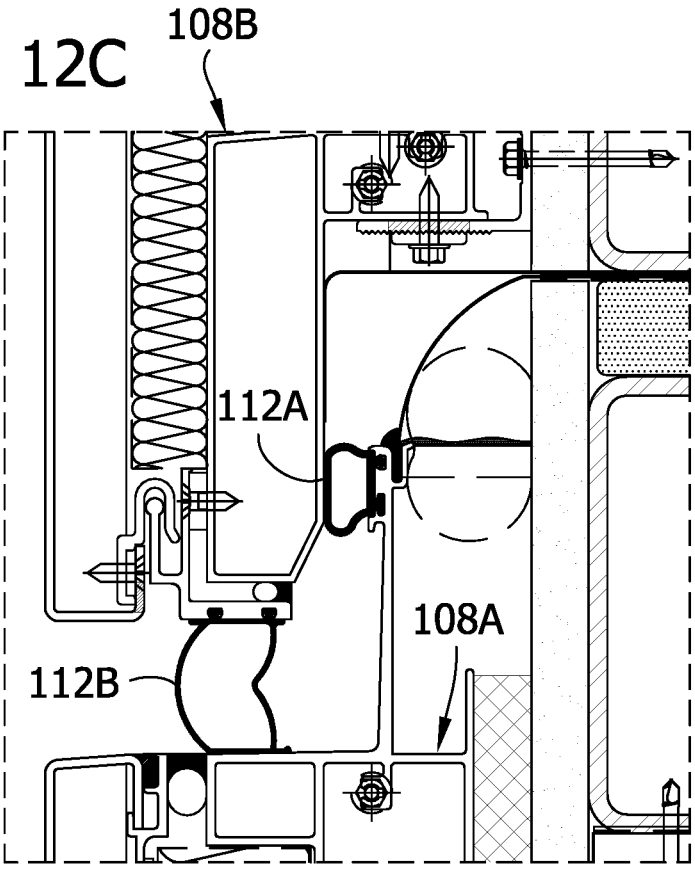
FIG. 12C is similar to FIG. 12A but illustrates the horizontal intersection in an expanded state.

The upper, lower, first side and second side frame members 108A-D (specifically, the respective first, second, third and fourth weather-proofing interfaces 102A-D thereof) are configured to maintain their seal with the respective exterior joint systems 100 of the other modular building units 12 the frame members engage as the modular building units move with respect to each other as assembled into the building framework 10. Referring to FIG. 10, the sealing intersection between two exterior joint systems 100 for two modular building units 12 stacked on top of one another is shown. Specifically, the first weather-proofing interface 102A of an upper frame member 108A is shown mated with the second weather-proofing interface 102B of a lower frame member 108B. The first weather strip 112A of the first weather-proofing interface 102A engages the lip 106B of the second weather-proofing interface 102B and the second weather strip 112B of the second weather-proofing interface engages the base 110A of the first weather-proofing interface to form the seal between the two exterior joint systems 100. The engagement with the first and second weather strips 112A, 112B resiliently deflects the weather strips to form the fluid and moisture tight seal between exterior joint systems 100. As shown in FIGS. 12A-12C, the first and second weather strips 112A, 112B maintain the seal between the first and second weather-proofing interfaces 102A, 102B (broadly, maintain the seal between the two exterior joint systems 100) even as the exterior joint systems (broadly, the modular building units 12) move relative to one another. This configuration also allows the seal between the first and second weather-proofing interfaces 102A, 102B to form even though there may be some variation in the position between adjacent exterior joint systems 100 when assembling the modular building units 12 into the building framework 10. In other words, the first and second weather strips 112A, 112B accommodate large tolerance variations between modular building units 12 in the building framework 10. For example, in the illustrated embodiment, the second weather strip 112B provides about 1.5 inches of vertical tolerance between the exterior joint systems 100 (e.g., permits about ±0.75 inches of vertical movement from the nominal position (FIG. 12A)). Such a large amount of tolerance is preferable in modular construction, as variations in the nominal or ideal relative positions between modular building units 12 frequently occur within the building framework 10.

Figure 11:
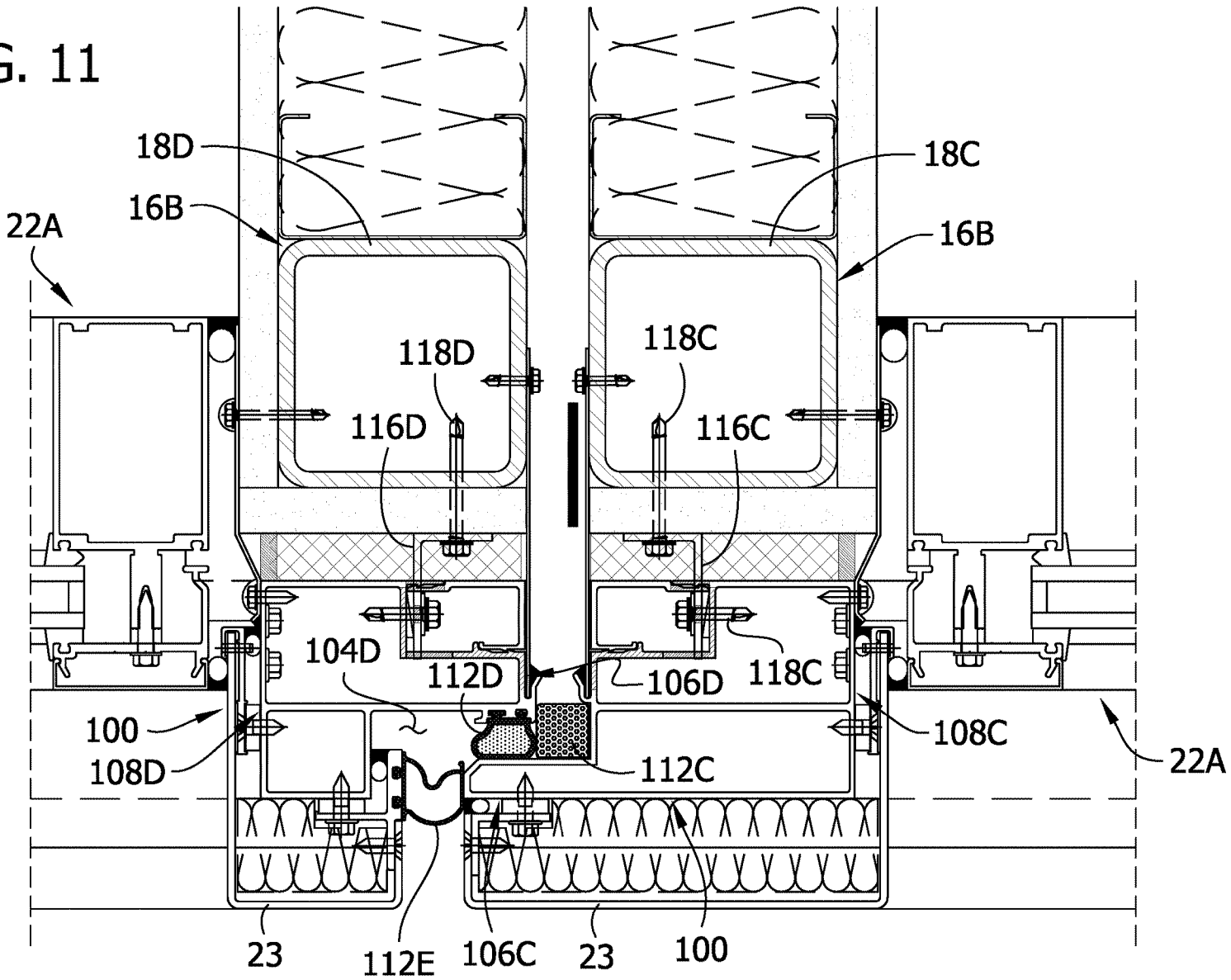
FIG. 11 is an enlarged, fragmentary horizontal section showing a vertical intersection between two modular building assemblies.
Figure 13A:
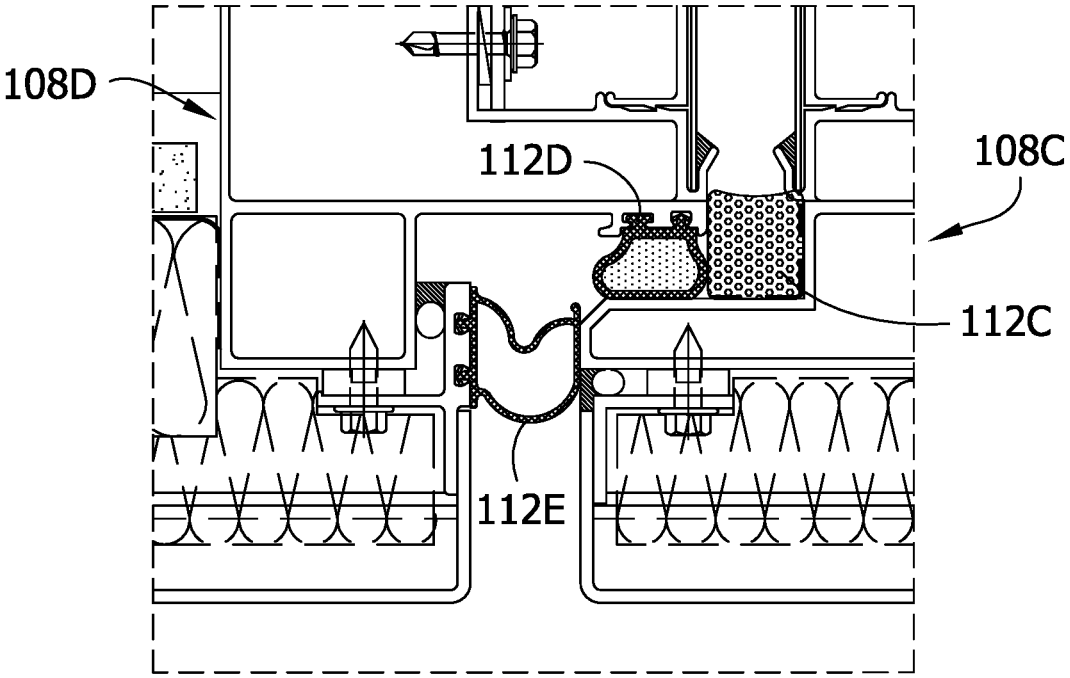
FIG. 13A is similar to FIG. 11 and illustrates the vertical intersection in a nominal state.
Figure 13B:
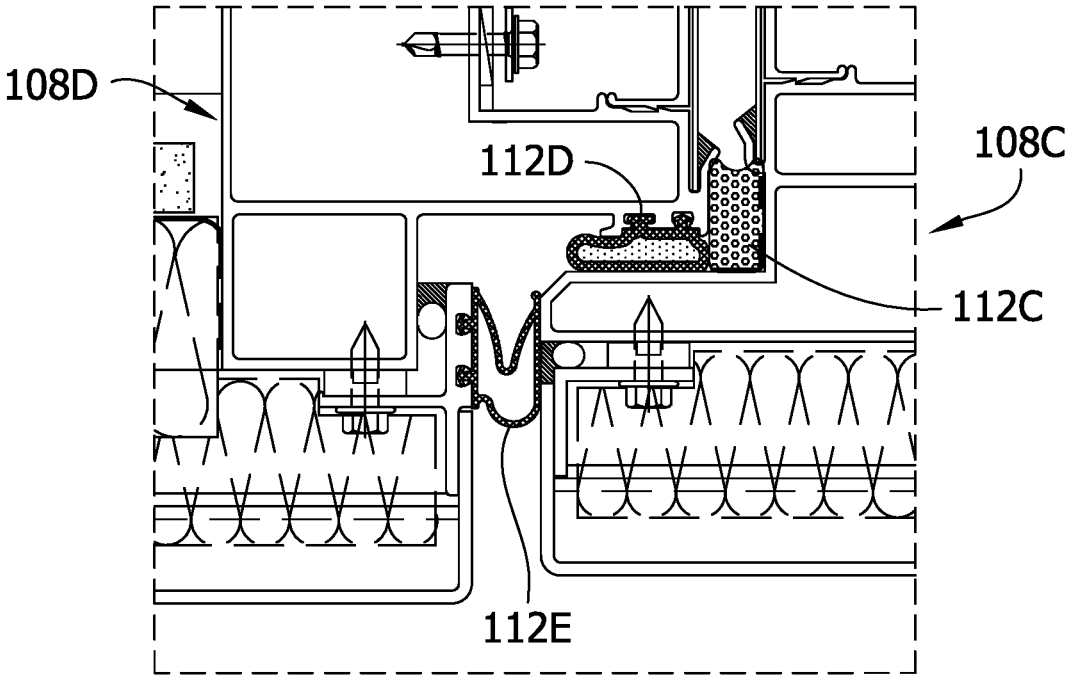
FIG. 13B is similar to FIG. 13A but illustrates the vertical intersection in a compressed state.
Figure 13C:
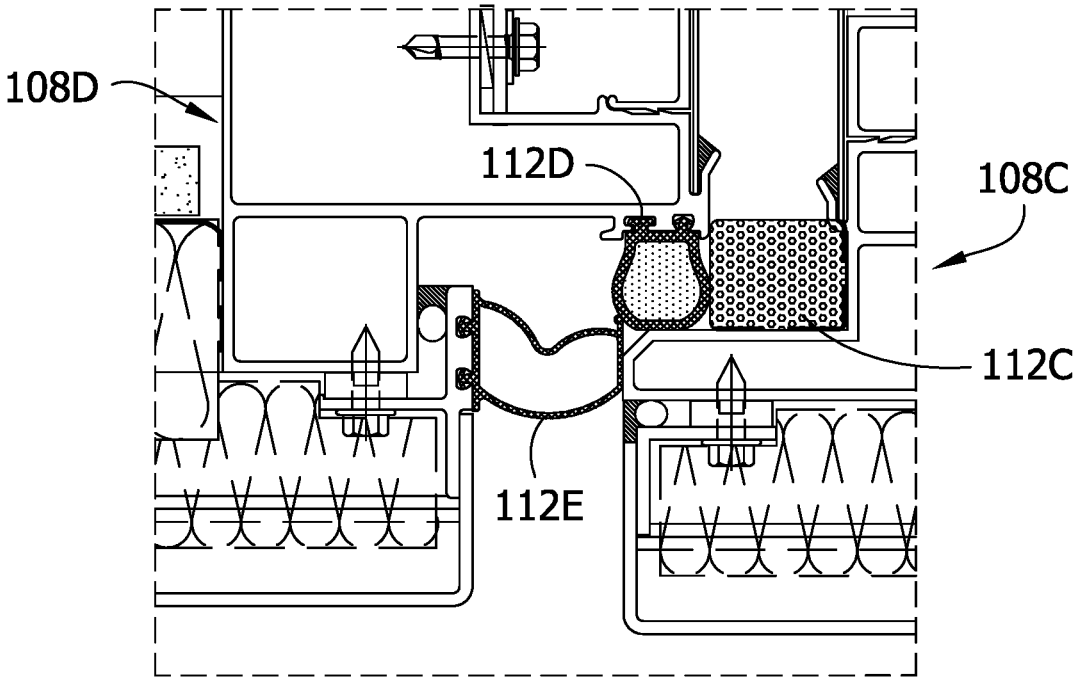
FIG. 13C is similar to FIG. 13A but illustrated the vertical intersection in an expanded state.

Referring to FIG. 11, the sealing intersection between two exterior joint systems 100 for two modular building units 12 arranged side-by-side is shown. Specifically, the third weather-proofing interface 102C of a first side upper frame member 108C is shown mated with the fourth weather-proofing interface 102D of a second side frame member 108D. The third weather strip 112C of the third weather-proofing interface 102C engages the lip 106D (e.g., end thereof) of the fourth weather-proofing interface 102D, the fourth weather strip 112D of the fourth weather-proofing interface engages the lip 106C of the third weather-proofing interface, and the fifth weather strip 112E of the fourth weather-proofing interface engages the lip 106C (e.g., end thereof) of the third weather-proofing interface to form the seal between the two exterior joint systems 100. The engagement with the third, fourth, and fifth weather strips 112C-E resiliently deflects the weather strips to form the fluid and moisture tight seal between exterior joint systems 100. As shown in FIGS. 13A-13C, the third, fourth, and fifth weather strips 112C-E maintain the seal between the third and fourth weather-proofing interfaces 102C, 102D (broadly, maintain the seal between the two exterior joint systems 100) even as the exterior joint systems (broadly, the modular building units 12) move relative to one another. This configuration also allows the seal between the third and fourth weather-proofing interfaces 102C, 102D to form even though there may be some variation in the position between adjacent exterior joint systems 100 when assembling the modular building units 12 into the building framework 10. In other words, the third, fourth, and fifth weather strips 112C-D accommodate large tolerance variations between modular building units 12 in the building framework 10. For example, in the illustrated embodiment, the fifth weather strip 112D provides about 1.5 inches of horizontal tolerance between the exterior joint systems 100 (e.g., permits about ±0.75 inches of horizontal movement from the nominal position (FIG. 13A)). Such a large amount of tolerance is preferable in modular construction, as variations in the nominal or ideal relative positions between modular building units 12 frequently occur within the building framework 10.

As shown in FIGS. 10 and 11, the overlapping of the weather-proofing interfaces 102 creates a double seal via at least two weather strips (weather strips 112A and 112B for the horizontal interface and weather strips 112D and 112E for the vertical interface). The double seal creates the void of air between the weather strips (a void between weather strips 112A and 112B and a void between weather strips 112D and 112E). This void of air inhibits the ability for fluid, moisture and/or vapor to penetrate the double seal. In addition, in the illustrated embodiment, the positioning of the weather strips 112A, 112B, 112D, and 112E is strategic. Weather strips 112B and 112E are disposed at the outer most edge of the weather proofing interface 102 and are exposed to the outside environment. Weather strips 112A and 112D are disposed more interiorly, within the confines of the overlapping section of the weather proofing interface 102, and are exposed to the inside environment. This creates the enclosed, insulated void or pocket (generally coextensive with 104A and 104D in FIGS. 10 and 11, respectively) between the weather strips, which creates a redundant and additional layer of protection against air flow and fluidizable debris.

The exterior joint system 100 is configured to be used with different types/styles of facades, such as conventional stud frame facades or window wall facades. Other types of facades are within the scope of the present disclosure.

Referring back to FIGS. 2-5, the exterior joint system 100 defines a facade opening 120 sized and shaped to receive a portion of the facade (e.g., the facade section 22) of the building. Specifically, the upper and lower frame members 108A, 108B connect to and extend between the first and second side frame members 108C, 10D such that the upper, lower, first side, and second side frame members define the facade opening 120. When the exterior joint system 100 is mounted on the exterior side of the modular building unit 12, the facade opening 120 is aligned with the exterior opening 24 of the exterior side of the modular building unit. Preferably, the facade opening 120 has a height and a width that is equal to or greater than the respective height and width of the exterior opening 24. This way, the facade section 22 can be mounted in the exterior opening 24 and supported by the structural frame 16 without any interference from the exterior joint system 100. Referring to FIGS. 10 and 11, in the illustrated embodiment, the exterior joint system 100 is arranged such that when mounted to the structural frame 16, a lower-most surface of the upper frame member 108A is generally flush (e.g., horizontally aligned) with the upper side of the exterior opening 24 and an upper-most surface of the lower frame member 108B is generally flush with the lower side of the exterior opening. Similarly, inner-most surfaces of the first and second side frame members 108C, 108D are slightly outwardly offset from the respective left and right sides of the exterior opening 24 when the exterior joint system 100 is mounted to the structural frame 16. This configuration allows the facade section 22 and the exterior joint system 100 to be installed on the modular building unit 12 independently of one another.

Figure 14:
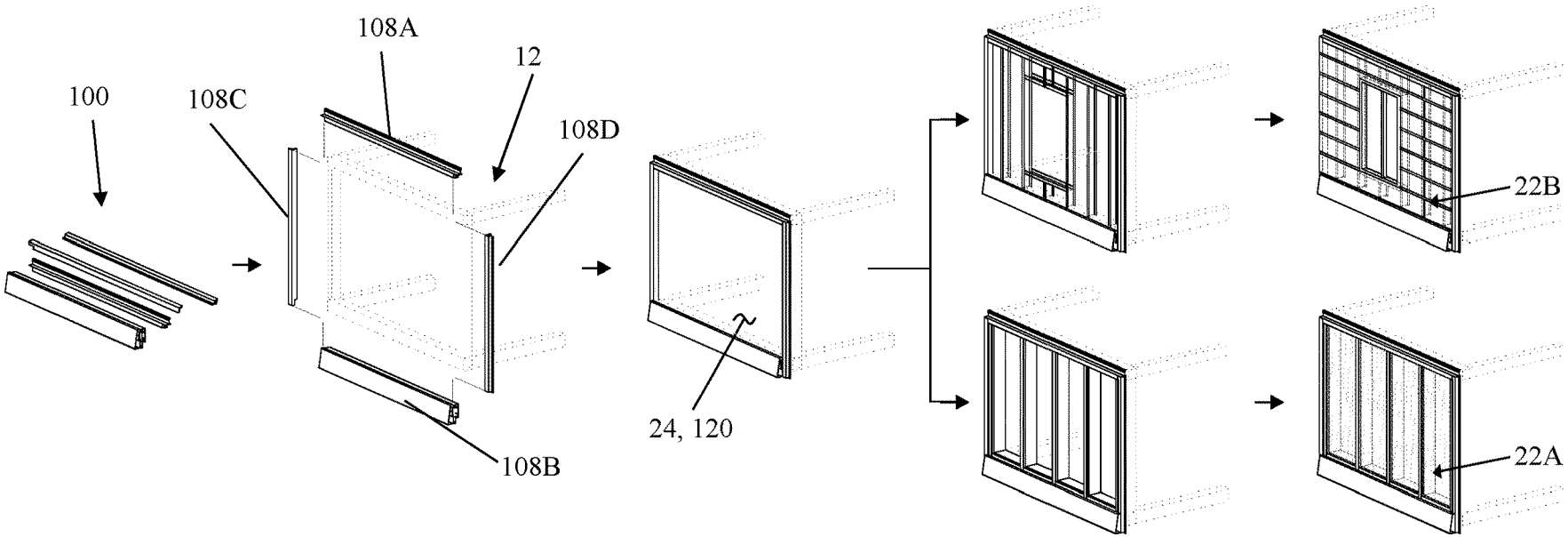
FIG. 14 illustrates the steps for attaching the exterior joint system and facade to the modular building unit.

Referring to FIG. 14, one method of assembling the modular building assembly is generally illustrated. In this method, the exterior joint system 100 is mounted or attached to the exterior side of the modular building unit 12, as described herein. Generally speaking, the facade opening 120 of the exterior joint system 100 is aligned with the exterior opening 24 of the exterior side of the module building unit 12. More particularly, the upper frame member 108A is mounted to the upper structural member 18A, the lower frame member 108B is mounted to the lower structural member 18B, the first side frame member 108C is mounted to the first side structural member 18C, and the second side frame member 108D is mounted to the second side structural member 18B. The end portions of the upper, lower, first side, and second side frame members 108A-D may also be connected to each other such as with self-tapping or self-drilling fasteners. In one embodiment, the frame members 108A-D are attached together before being mounted on modular building unit 12. This allows the frame members 108A-D to be placed in accurate positions (e.g., "squared") independently of the structural frame 16 of the modular building unit 12. It is faster and easier for a builder or construction worker to square up the frame members 108A-D before they are attached to structural frame 16. Thus, the geometrical precision of the connected frame members 108A-D is not dependent upon the structural frame 16 being as accurately square. This can facilitate mating of exterior joint systems 100 of adjacent modular building units 12. In another embodiment, the frame members 108A-D may be mounted to the modular building unit 12 before being attached to one another. After the exterior joint system 100 is attached to the structural frame 16, flashing and sealant can be added (as shown) to form a seal between the exterior joint system 100 and the structural frame. As is apparent, the exterior joint system 100 is mounted to the structural frame 16 of the modular building unit 12 independently of the facade (e.g., the facade section).

After the exterior joint system 100 is attached to the structural frame 16, the facade section 22 is then mounted to the modular building unit. In the illustrated embodiment, a conventional stud frame facade section 22B and a window wall facade section 22A are shown as the different facade types that can be installed. However, it is understood other types of facades (e.g., other types of facade sections) may be used. To install the facade section 22, the facade section is position in the exterior opening 24. This may include positioning the facade section 22 in the facade opening 120 of the exterior joint system 100 as well. When installing the facade section 22, the facade section is mounted on and supported by the structural frame 16, not the exterior joint system 100. In particular, in reference to FIG. 10, the facade section 22 is mounted on and supported by the lower structural member 18B. FIGS. 10 and 11 show the window wall facade section 22A mounted to the structural frame 16. As shown in these figures, the window wall facade section 22A is free of any direct connection to the exterior joint system 100. In this embodiment, the window wall facade includes covers or panels 23 (e.g., rain screen panels or broadly, siding), distinct from the window wall facade section 22A, that are connected or mounted to the exterior joint system (via the attachment points 114A-D). In for other types of facade sections 22, such as conventional stud frame facade sections 22B, the facade section may be connected to one or more of the frame member 108A-D. In one example (not shown), the conventional stud frame facade section 22B includes rain screen panels or covers that can be connected to the exterior joint system 100 (via the attachment points 114A-D). In this embodiment, the rain screen panels (and/or other portions of the facade section 22B) may extend over and cover portions of the exterior joint system 100 (broadly, the facade section covers at least a portion of the exterior joint system). Even though the facade section 22 may be connected to the exterior joint system 100, these connections are not substantially weight bearing and are primarily for preventing gaps from forming between the facade section 22 and exterior joint system. Accordingly, regardless of the type of facade section 22 installed, the facade section is generally free of support from the exterior joint system 100 and, depending on the type of facade section (e.g., window wall facade section 22B), is entirely free of support from the exterior joint system. Therefore, the weight of the facade section 22 is carried by the structural frame 16.

When the facade section 22 is attached to the modular building unit 12, the facade section is disposed in the exterior opening 24. The facade section 22 fits within and generally fills up the exterior opening 24. The facade section 22 may also extend forward of the exterior opening 24 and be disposed in the facade opening 120 of the exterior joint system 100 (FIGS. 10 and 11). Regardless, the facade section 22 is aligned with the facade opening such that generally the entire facade section 22, and preferably the entire facade section, is visible through the facade opening 120. In other words, the exterior joint system 100, preferably, does not cover any portion of the facade section 22. After the facade section 22 is positioned in the modular building unit 12, sealant and or flashing can be added (as shown) to form a seal between the facade section and the structural frame 16 and/or the facade section and the exterior joint system 100.

In the illustrated method, after the facade section 22 is installed, the modular building assembly (e.g., the modular building unit 12 with the exterior joint system 100 and facade section 22 secured thereto) is positioned next to another modular building assembly in the building framework 10. As a result, the weather-proofing interface 102 of the exterior joint system 100 engages the weather-proofing interface of the exterior joint system of the other modular building assembly to form the seal between the exterior joint systems. If the modular building assembly is stacked onto the other modular building assembly, respective first and second weather-proofing interfaces 102A, 102B of each modular building assembly mate with one another to form the seal, as shown in FIG. 10. Similarly, if the modular building assembly is placed side-by-side with the other modular building assembly, respective third and fourth weather-proofing interface 102C, 102D of each modular building assembly mate with one another to form the seal, as shown in FIG. 11. When positioned in the building framework 10, one exterior joint system 100 of one modular building assembly is free of a fixed connection with the other exterior joint systems the one exterior joint system engages. This permits the exterior joint systems 100 to move relative to each other and accommodate various different tolerances between modular building assemblies, as described herein.

This process is generally repeated until all the modular building assemblies are positioned in the building framework 10. Once the modular building assemblies are positioned in the building framework 10, the weather-proofing interface 102 of the exterior joint system 100 mates with the corresponding structure of the weather-proofing interfaces of the exterior joint systems of the other modular building assemblies, thereby forming a substantially continuous seal around each exterior joint system (broadly, around each modular building unit 12). Accordingly, when the modular building assemblies are positioned in the building framework 10, the weather-proofing interfaces 102 create a substantially gap-free seal between the modular building assemblies to inhibit the outside environment from flowing into the interior of the building, and vice versa. As a result, the overall time to construct the building is reduced, specifically over conventional modular construction which requires which require manually sealing or caulking between adjacent modular building units.

Figure 15:
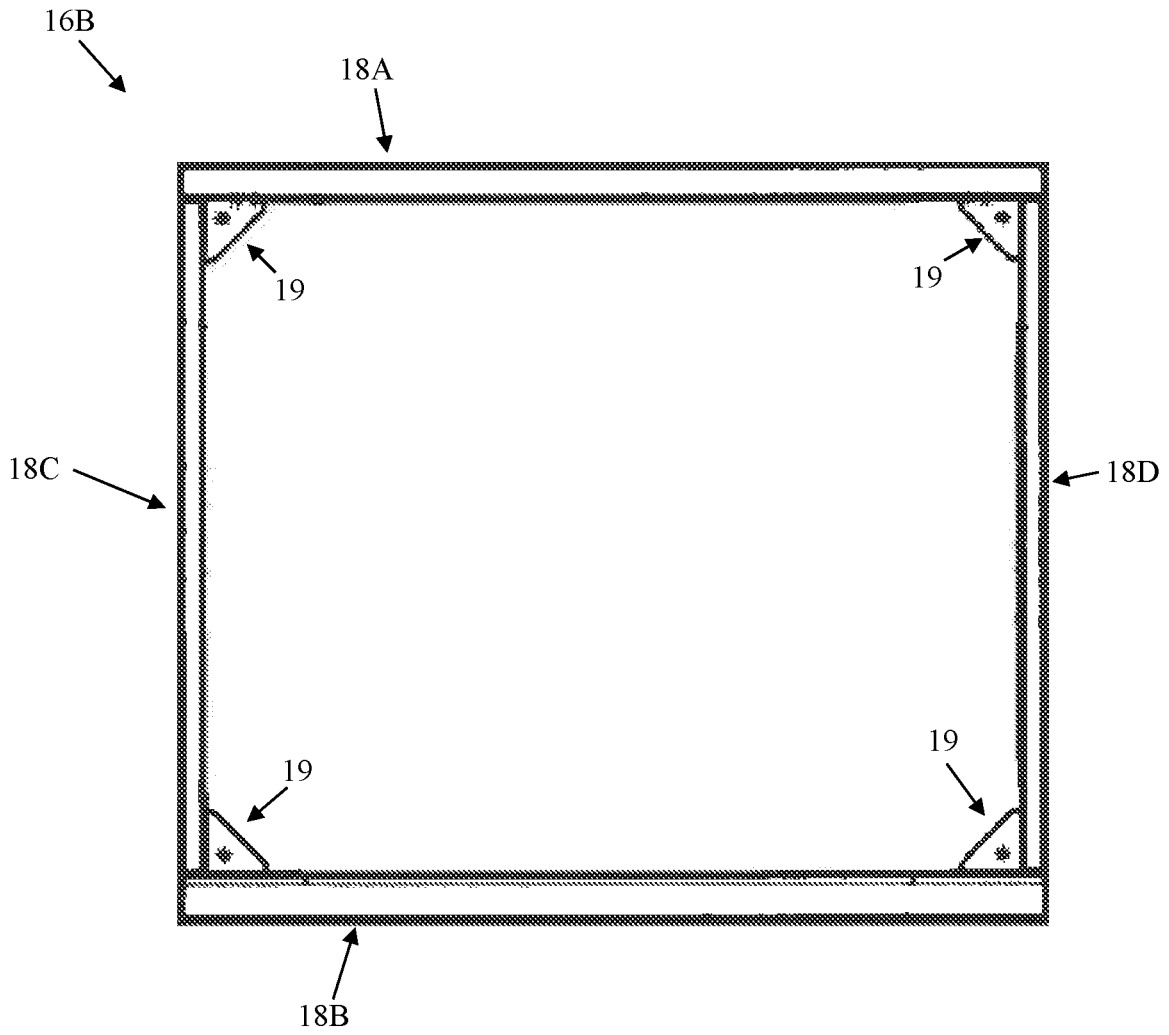
FIG. 15 is a front elevation of one embodiment of a mounting frame according to one embodiment of the present disclosure.
Figure 16:
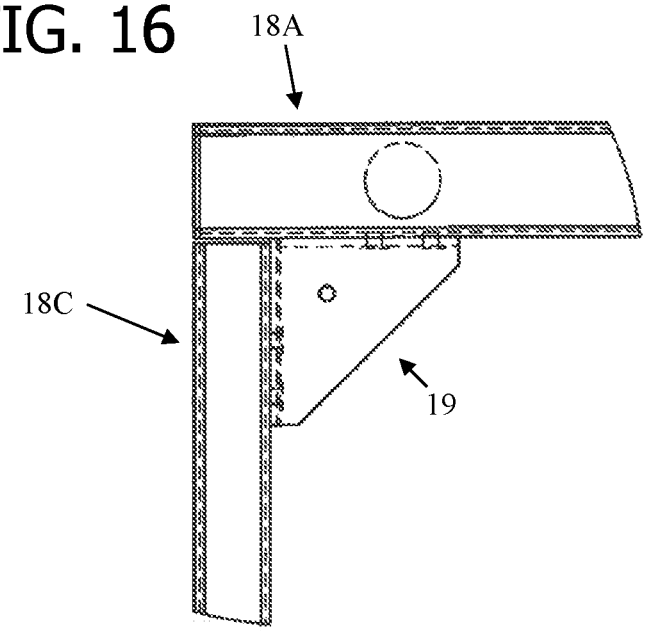
FIG. 16 is an enlarged, fragmentary view of FIG. 16.
Figure 17:
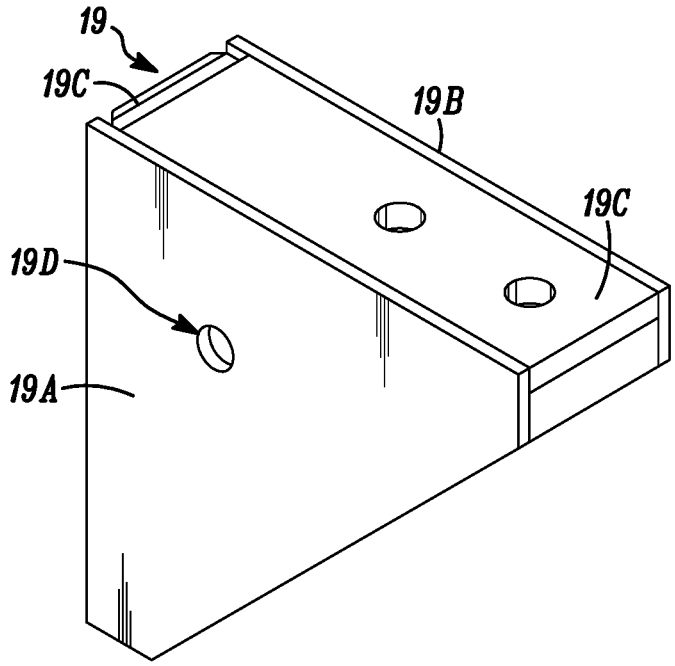
FIG. 17 is a perspective of a corner bracket of the mounting frame of FIG. 15.

Referring to FIGS. 15-17, one embodiment of a mounting frame 16B of the present disclosure is shown. As described above, the mounting frame 16B is generally rectangular with interconnected structural members 18A-D. In this embodiment, the mounting frame 16B includes corner or connection brackets 19. The connection brackets 19 are disposed at the intersections of the structural members 18A-D and are used to connect the structural members together. The connection brackets 19 are generally triangularly shaped with a front plate 19A, a back plate 19B, and two side plates 19C. The connection brackets 19 are secured to the structural members 18A-D they interconnect. In the illustrated embodiment, the connection brackets 19 are bolted to the structural members, although other means of attachment, such as welding, are within the scope of the present disclosure. The connection brackets 19 also include anchors or attachment points 19D. In the illustrated embodiment, the anchors 19D comprise openings.

The connection brackets 19 serve two purposes. First, the connection brackets connect the structural members 18A-D together. Second, the anchors 19D of the connection brackets 19 can be used to attached chains with ratchets or other squaring tools thereto. For example, by attaching chains diagonally between two connection brackets 19, the chains can be tensions to perfectly square up the mounting frame 16B, before the mounting frame is attached to the structural cage 16A. The squared up mounting frame 16B can then be attached to the structural cage 16A. In one embodiment, during placement and installation of the modular building unit 12 in the building framework 10, the mounting frames 16B (and not structure on the structural cage 16A) serve as datum points for the indexing of one modular building unit next to another. In practice, the structural cage 16A will not be perfectly square, thereby creating small alignment issues that would otherwise need to be accounted for when the modular building units 12 are arranged in the building framework 12. However, it is possible to achieve a high degree of precision in the construction of the mounting frame 16B. Allowing a builder to use the perfectly square mounting frames 16B as points of reference when arranging the modular building units 12 relative to one another, allows the builder to ignore the any variances in the structural cages 16A when installing the units and forming the modular building unit to modular building unit connections. In particular, the mounting frames 16B make certain that the exterior joint systems 100 are aligned properly with each other, independently of the alignment of the structural cages 16A. The perfectly square mounting frame 16B can also act as a square/jigging alignment reference for the rest of the modular building unit 12.

Figure 18:
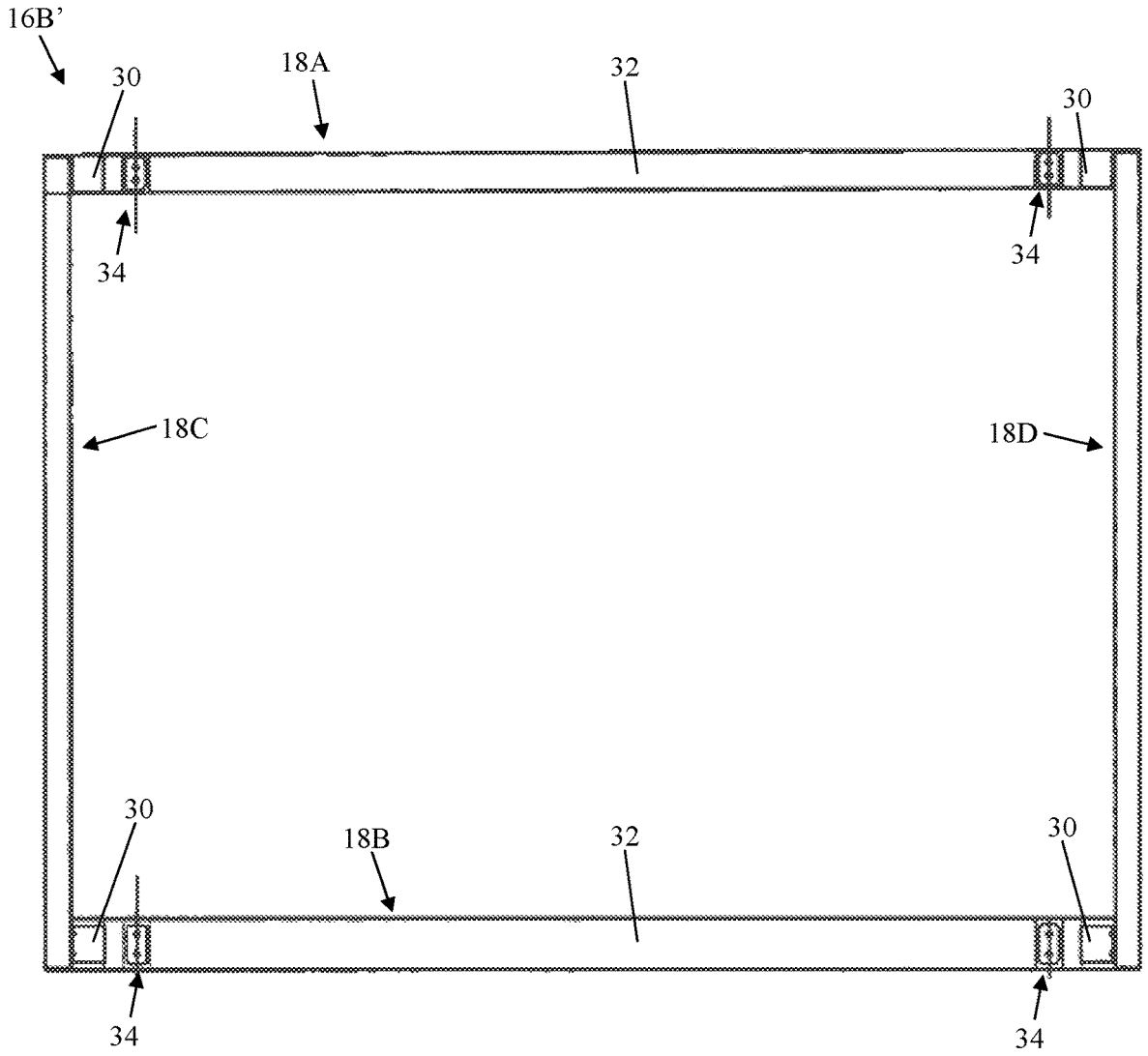
FIG. 18 is a front elevation of another embodiment of a mounting frame according to one embodiment of the present disclosure.
Figure 19:
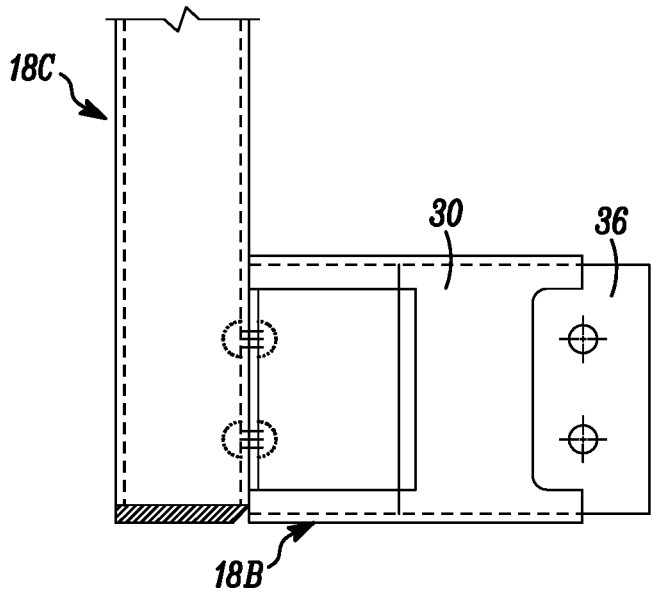
FIG. 19 is an enlarged, fragmentary view of a portion of the mounting frame of FIG. 18.
Figure 20:
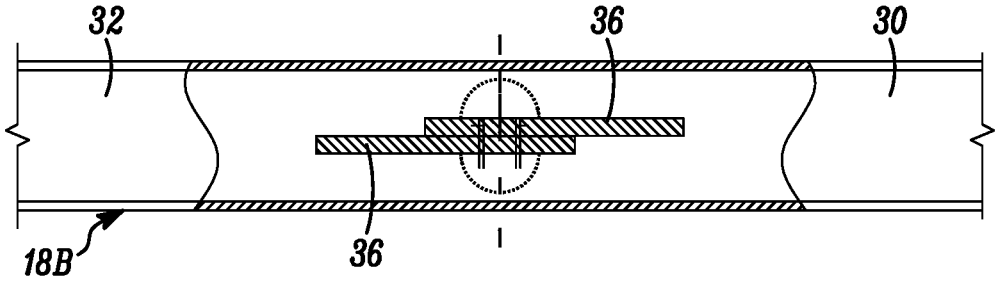
FIG. 20 is an enlarged, fragmentary top plan view of the butt connection of the mounting frame of FIG. 18 with portions removed to show internal construction.

Referring to FIGS. 18-20, another embodiment of a mounting frame 16B' of the present disclosure is generally shown. As with the mounting frame 16B of FIGS. 15-17, the mounting frame 16B' of FIGS. 18-20 can also be used with the modular building unit 12 and perform the same functions described above. In this embodiment, the structural members 18A-D are connected together by butt or splice connections, instead of the connection brackets 19, although other types of connections are within the scope of the present disclosure. In the illustrated embodiment, the upper and lower structural members 18A, 18B each include two splice connections 34. In other embodiments, other structural members may include one or more splice connection (broadly, at least one structural member includes at least one splice connection). The upper and lower structural members 18A, 18B each include opposite end portions 30 secured (e.g., bolted, welded, etc.) to the respective side structural members 18C, 18D, and an intermediate portion 32. The intermediate portion 32 is secured to the two end portions 30 by the splice connections 34. The splice connections 34 are all generally identical so one splice connection will now be described with the understanding it applies to all the splice connections.

The splice connection 34 comprises two connection members or plates 36, one carried by the end portion 30 and one carried by the intermediate portion 32. Each connection member 36 is at least partially disposed within a respective one of the end or intermediate portions 30, 32 (e.g., portions of the HSS beams). The connection members 36 are configured to be secured together. In the illustrated embodiment, the connection members 36 each have openings that align with one another for bolts (not shown) to extend therethrough. The portions 30, 32 each include a cutout positioned to expose at least the portion of the connection members 36. Together the cutouts cooperatively form a window or access opening when the portions 30, 32 are mated together to provide access to the connection members 36 through the window. The cutouts are preferably included on both sides of the portions 30, 32. The connection members 36 overlap one another when the portions 30, 32 are mated together.

The connection brackets 19 of the mounting frame 16B of FIGS. 15-17 and the splice connections 34 of the mounting frame 16B' of FIGS. 18-20, enable the components of the mounting frames 16B, 16B' to be manufactured at one location and then easily transported, in pieces, to another location, such as a factory, where it can be assembled, squared and attached to the structural cage 16A.

FIGS. 10-13C are cross-section views of the exterior joint system 100. For clarity and simplicity, only some of the components in these cross-sections are shown with cross-section hatching, indicating the cross-section plane intersected those components. It is understood that other components may have been intersected by the cross-section plane but are nevertheless shown without cross-section hatching. It is well within the capabilities of a person having ordinary skill in the art to determine what components without cross-section hatching are in fact intersected by the cross-section plane based on the provided figures and the description herein. For example, it is understood the lips 106A-D are intersected by the cross-section plane in each of FIGS. 10-13C.

Other Statements of the Invention

A1. A method of constructing a building comprising:

attaching an exterior joint system to an exterior side of a structural frame of a modular building unit, the exterior joint system having a weather-proofing interface extending along an outer perimeter of the exterior side of the modular building unit when the exterior joint system is attached to the exterior side of the modular building unit, the exterior joint system defining a facade opening sized and shaped to receive a portion of a facade of the building, said attaching including aligning the facade opening with an exterior opening defined by the exterior side of the structural frame of the modular building unit;

positioning the modular building unit next to another modular building unit such that the weather-proofing interface of the exterior joint system engages a weather-proofing interface of an exterior joint system attached to the other modular building unit to form a seal between the exterior joint systems.

A2. The method of claim A1, further comprising installing, before said positioning, the portion of the facade in the facade opening and the exterior opening.

A3. The method of claim A1, further comprising, before said attaching, forming the exterior joint system separate from the structural frame.

B1. A modular building assembly of a building, the modular building assembly comprising:

a modular building unit configured to form a portion of the building, the modular building unit including a structural frame having an exterior side configured to be arranged adjacent to an exterior of the building;

a façade mounted on the structural frame;

a joining frame mounted on the structural frame of the modular building unit independently of the facade, the joining frame including a weather-proofing interface extending along an outer perimeter of the joining frame, the weather-proofing interface configured to engage a joining frame of at least one other modular building assembly to form a seal with said at least one other modular building assembly when the modular building assembly and at least one other modular building assembly are arranged next to one another in the building.

C1. A method of forming a structural frame of a modular building unit, the method comprising:

forming a structural cage at least partially defining the structural frame;

forming a mounting frame separate from the structural cage;

squaring the mounting frame; and attaching, after said squaring, the mounting frame to the structural cage in a positon such that the mounting frame defines an exterior side of the structural frame.

C2. The method of claim C1, further comprising attaching an exterior joint system to the mounting frame.

D1. A mounting frame for defining an exterior side of a structural frame of a modular building unit, the mounting frame comprising:

an upper structural member;

a lower structural member;

a first side structural member connected to the upper and lower structural members;

a second side structural member connected to the upper and lower structural members;

a first connection bracket connecting the upper and first side structural members together;

a second connection bracket connecting the upper and second side structural members together;

a third connection bracket connecting the lower and first side structural members together; and a fourth connection bracket connecting the lower and second side structural members together;

wherein the first, second, third and fourth connection brackets are constructed for interconnection for use in squaring the mounting frame.

E1. A mounting frame for defining an exterior side of a structural frame of a modular building unit, the mounting frame comprising:

an upper structural member;

a lower structural member;

a first side structural member connected to the upper and lower structural members;

a second side structural member connected to the upper and lower structural members;

wherein at least one of the upper, lower, first side or second side structural members includes a splice connection.

While some numeric identifiers such as "first," "second," "third," and "fourth" may have been described herein in relation to a specific component, element, or feature, it is understood that any corresponding use of these numeric identifiers in the claims is not limited to referring to only said specific component, element or feature mention above. Instead, these numeric identifiers are used in the claims to identify different components.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An exterior joint system for a modular building unit forming a portion of a building, the building having other modular building units, the exterior joint system comprising:

an elongate, upper frame member configured to be attached to an upper structural member of the modular building unit, the upper frame member including a first weather-proofing interface configured to engage a first exterior joint system of a first other modular building unit to form a seal with said first exterior joint system when the upper frame member is attached to the modular building unit and the modular building unit is positioned adjacent said first other modular building unit, the elongate, upper frame member being independent of the modular building unit and the first other modular building unit;

an elongate, lower frame member configured to be attached to a lower structural member of the modular building unit, the lower frame member including a second weather-proofing interface configured to engage a second exterior joint system of a second other modular building unit to form a seal with said second exterior joint system when the lower frame member is attached to the modular building unit and the modular building unit is positioned adjacent said second other modular building unit, the elongate, lower frame member being independent of the modular building unit and the second other modular building unit;

an elongate, first side frame member configured to be attached to a first side structural member of the modular building unit, the first side frame member including a third weather-proofing interface configured to engage a third exterior joint system of a third other modular building unit to form a seal with said third exterior joint system when the first side frame member is attached to the modular building unit and the modular building unit is positioned adjacent said third other modular building unit, the elongate, first side frame member being independent of the modular building unit and the third other module building unit; and an elongate, second side frame member configured to be attached to a second side structural member of the modular building unit, the second side frame member including a fourth weather-proofing interface configured to engage a fourth exterior joint system of a fourth other modular building unit to form a seal with said fourth exterior joint system when the second side frame member is attached to the modular building unit and the modular building unit is positioned adjacent said fourth other modular building unit, the elongate, second side frame member being independent of the modular building unit and the fourth other modular building unit;

the upper and lower frame members configured to connect to and extend between the respective first and second side frame members such that the upper, lower, first side and second side frame members define a facade opening sized and shaped to receive a portion of a facade of the building, wherein each weather-proofing interface of the upper, lower, first side and second side frame members is configured to overlap said respective first, second, third, or fourth exterior joint systems creating a double seal, and wherein each weather-proofing interface of the upper and lower frame members is configured to vertically overlap said respective first or second exterior joint systems, and wherein each weather-proofing interface of the first side and second side frame members is configured to horizontally overlap said respective third or fourth exterior joint systems.

2. The exterior joint system of claim 1, wherein each weather-proofing interface of the upper, lower, first side and second side frame members includes at least one of a lip and a recess, the lip arranged to extend into a recess of said respective first, second, third or fourth exterior joint system, the recess sized and shaped to receive a lip of said respective first, second, third or fourth exterior joint system.

3. The exterior joint system of claim 1, wherein one or more of the weather-proofing interfaces of the upper, lower, first side and second side frame members includes a weather strip arranged to engage said respective first, second, third or fourth exterior joint system.

4. The exterior joint system of claim 3, wherein the weather strip comprises a resiliently compressible bulb gasket.

5. The exterior joint system of claim 4, wherein the gasket has a height of at least 1.75 inches (4.45 cm).

6. The exterior joint system of claim 1, wherein:

the first weather-proofing interface of the upper frame member defines a recess having an open top arranged to face generally upward when the upper frame member is attached to the modular building unit;

the second weather-proofing interface of the lower frame member includes a lip arranged to extend generally downward when the lower frame member is attached to the modular building unit;

the third weather-proofing interface of the first side frame member includes a lip arranged to extend generally outward when the first side frame member is attached to the modular building unit; and the fourth weather-proofing interface of the second side frame member defines a recess having an open second side arranged to face generally outward when the second side frame member is attached to the modular building unit.

7. The exterior joint system of claim 6, wherein:

the first weather-proofing interface of the upper frame member includes a weather strip disposed in the recess of the first weather-proofing interface of the upper frame member, the weather strip arranged to engage the first exterior joint system;

the second weather-proofing interface of the lower frame member includes a weather strip arranged to engage the second exterior joint system; and the fourth weather-proofing interface of the second side frame member includes first and second weather strips disposed in the recess of the fourth weather-proofing interface of the second side frame member, the first and second weather strips arranged to engage the fourth exterior joint system.

8. The exterior joint system of claim 1, wherein:

the first weather-proofing interface of the upper frame member includes a lip arranged to extend generally upward when the upper frame member is attached to the modular building unit;

the second weather-proofing interface of the lower frame member defines a recess having an open bottom arranged to face generally downward when the lower frame member is attached to the modular building unit;

the third weather-proofing interface of the first side frame member defines a recess having an open first side arranged to face generally outward when the first side frame member is attached to the modular building unit; and the fourth weather-proofing interface of the second side frame member includes a lip arranged to extend generally outward when the second side frame member is attached to the modular building unit.

9. The exterior joint system of claim 1, wherein each of the upper, lower, first side and second side frame members includes a mounting bracket configured to be attached to the respective upper, lower, first side or second side structural member.

10. The exterior joint system of claim 1 wherein the upper and lower frame members, and the first and second frame members are configured to maintain a seal with the first, second, third and fourth modular building units as the first, second, third and fourth modular building units move with respect to each other as assembled into the building.

* * * * *